US008500413B2

(12) United States Patent
Stiles, Jr. et al.

(10) Patent No.: US 8,500,413 B2
(45) Date of Patent: Aug. 6, 2013

(54) PUMPING SYSTEM WITH POWER OPTIMIZATION

(75) Inventors: Robert W. Stiles, Jr., Cary, NC (US); Lars Hoffmann Berthelsen, Kolding (DK); Ronald B. Robol, Sanford, NC (US); Christopher R. Yahnker, Raleigh, NC (US); Einar Kjartan Runarsson, Soenderborg (DK)

(73) Assignees: Pentair Water Pool and Spa, Inc., Sanford, NC (US); Danfoss Low Power Drives A/S, Graasten (DK)

( * ) Notice: Subject to any disclaimer, the term of this patent is extended or adjusted under 35 U.S.C. 154(b) by 234 days.

(21) Appl. No.: 12/749,247

(22) Filed: Mar. 29, 2010

(65) Prior Publication Data

US 2010/0254825 A1 Oct. 7, 2010

Related U.S. Application Data

(60) Division of application No. 11/609,029, filed on Dec. 11, 2006, now Pat. No. 7,686,589, which is a continuation-in-part of application No. 10/926,513, filed on Aug. 26, 2004, now Pat. No. 7,874,808, and a continuation-in-part of application No. 11/286,888, filed on Nov. 23, 2005, now Pat. No. 8,019,479.

(51) Int. Cl.
*F04B 49/06* (2006.01)

(52) U.S. Cl.
USPC ..... 417/44.1; 417/20; 417/36; 417/42; 417/44.11; 417/46; 210/167.01; 210/167.14

(58) Field of Classification Search
USPC ..... 417/1, 12, 40, 42, 44.11; 210/167.1, 210/167.12, 167.13
See application file for complete search history.

(56) References Cited

U.S. PATENT DOCUMENTS 1,061,919 A 5/1913 Miller
1,993,267 A 3/1935 Ferguson (Continued)

FOREIGN PATENT DOCUMENTS

DE 3023463 2/1981
DE 19736079 8/1997

(Continued)

OTHER PUBLICATIONS

Shabnam Mogharabi; "Better, Stronger, Faster;" Pool and Spa News; pp. 1-5; Sep. 3, 2004; www/poolspanews.com.

(Continued)

*Primary Examiner* — Charles Freay
*Assistant Examiner* — Patrick Hamo
(74) *Attorney, Agent, or Firm* — Quarles & Brady LLP

(57) ABSTRACT

The present invention provides a pumping system for moving water of a swimming pool, including a water pump and a variable speed motor. In one example, a target volume amount of water and an operational time period is provided, and the operational time period is altered based upon a volume of water moved. In another example, operation of the motor is altered based upon the volume of water moved. In addition or alternatively, a target flow rate of water to be moved by the water pump is determined based upon the target volume amount and a time period. In addition or alternatively, a plurality of operations are performed on the water, and a total volume of water moved by the pump is determined. In addition or alternatively, an optimized flow rate value is determined based upon power consumption.

15 Claims, 8 Drawing Sheets

(56) References Cited

U.S. PATENT DOCUMENTS 2,238,597 A 4/1941 Page
2,458,006 A 1/1949 Kilgore
2,488,365 A 11/1949 Abbott et al.
2,494,200 A 1/1950 Ramqvist
2,615,937 A 10/1952 Ludwig et al.
2,716,195 A 8/1955 Anderson
2,767,277 A 10/1956 Wirth
2,778,958 A 1/1957 Hamm et al.
2,881,337 A 4/1959 Wall
3,191,935 A 6/1965 Uecker
3,204,423 A 9/1965 Resh, Jr.
3,213,304 A 10/1965 Landerg et al.
3,227,808 A 1/1966 Morris
3,291,058 A 12/1966 McFarlin
3,481,973 A 12/1969 Wygant
3,558,910 A 1/1971 Dale et al.
3,559,731 A 2/1971 Stafford
3,581,895 A 6/1971 Howard et al.
3,613,805 A 10/1971 Lindstad
3,737,749 A 6/1973 Schmit
3,778,804 A 12/1973 Adair
3,787,882 A 1/1974 Fillmore
3,838,597 A 10/1974 Montgomery et al.
3,902,369 A 9/1975 Metz
3,949,782 A 4/1976 Athey et al.
3,953,777 A 4/1976 McKee
3,963,375 A 6/1976 Curtis
4,021,700 A 5/1977 Ellis-Anwyl
4,041,470 A 8/1977 Slane et al.
4,123,792 A 10/1978 Gephart et al.
1,339,058 A 1/1979 Baker
4,151,080 A * 4/1979 Zuckerman et al. ..... 210/741
4,168,413 A 9/1979 Halpine
4,225,290 A 9/1980 Allington
4,241,299 A 12/1980 Bertone
4,263,535 A 4/1981 Jones
4,286,303 A 8/1981 Genheimer et al.
4,319,712 A 3/1982 Bar
4,322,297 A 3/1982 Bajka
4,353,220 A 10/1982 Curwen
4,370,098 A 1/1983 McClain et al.
4,384,825 A 5/1983 Thomas
4,402,094 A 9/1983 Sanders
4,419,625 A 12/1983 Bejot et al.
4,420,787 A 12/1983 Tibbits et al.
4,421,643 A 12/1983 Frederick
4,427,545 A 1/1984 Arguilez
4,449,260 A 5/1984 Whitaker
4,462,758 A 7/1984 Speed
4,470,092 A 9/1984 Lombardi
4,473,338 A 9/1984 Garmong
4,494,180 A 1/1985 Streater
4,504,773 A 3/1985 Suzuki et al.
4,505,643 A 3/1985 Millis et al.
D278,529 S 4/1985 Hoogner
4,541,029 A 9/1985 Ohyama
4,545,906 A 10/1985 Frederick
4,610,605 A 9/1986 Hartley
4,620,835 A 11/1986 Bell
4,635,441 A 1/1987 Ebbing et al.
4,647,825 A 3/1987 Profio et al.
4,676,914 A 6/1987 Mills et al.
4,678,404 A 7/1987 Lorett et al.
4,678,409 A 7/1987 Kurokawa
4,686,439 A 8/1987 Cunningham et al.
4,695,779 A 9/1987 Yates
4,703,387 A 10/1987 Miller
4,705,629 A 11/1987 Weir
4,758,697 A 7/1988 Jeuneu
4,767,280 A 8/1988 Markuson
4,780,050 A 10/1988 Caine et al.
4,795,314 A * 1/1989 Prybella et al. ..... 417/43
4,827,197 A 5/1989 Giebeler
4,834,624 A 5/1989 Jensen
4,837,656 A 6/1989 Barnes
4,841,404 A 6/1989 Marshall et al.
4,864,287 A 9/1989 Kierstead
4,885,655 A 12/1989 Springer et al.
4,891,569 A 1/1990 Light
4,907,610 A 3/1990 Meincke
4,912,936 A 4/1990 Denpou
4,913,625 A 4/1990 Gerlowski
4,963,778 A 10/1990 Jensen
4,971,522 A 11/1990 Butlin
4,977,394 A 12/1990 Manson et al.
4,985,181 A 1/1991 Strada et al.
4,986,919 A 1/1991 Allington
4,996,646 A 2/1991 Farrington
D315,315 S 3/1991 Stairs, Jr.
4,998,097 A 3/1991 Noth et al.
5,026,256 A 6/1991 Kuwabara
5,076,761 A 12/1991 Krohn et al.
5,076,763 A 12/1991 Anastos et al.
5,079,784 A 1/1992 Rist et al.
5,099,181 A 3/1992 Canon
5,100,298 A 3/1992 Shibata et al.
RE33,874 E 4/1992 Miller
5,117,233 A 5/1992 Hamos et al.
5,123,080 A 6/1992 Gillett
5,151,017 A 9/1992 Sears et al.
5,156,535 A 10/1992 Budris
5,158,436 A 10/1992 Jensen
5,159,713 A 10/1992 Gaskill et al.
5,167,041 A 12/1992 Burkitt
5,172,089 A 12/1992 Wright et al.
D334,542 S 4/1993 Lowe
5,240,380 A 8/1993 Mabe
5,295,790 A 3/1994 Bossart
5,324,170 A 6/1994 Anastos et al.
5,327,036 A 7/1994 Carey
5,342,176 A 8/1994 Redlich
5,418,984 A 5/1995 Livingston et al.
D359,458 S 6/1995 Pierret
D363,060 S 10/1995 Hunger
5,471,125 A 11/1995 Wu
5,473,497 A 12/1995 Beatty
5,499,902 A 3/1996 Rockwood
5,511,397 A 4/1996 Makino et al.
5,512,883 A 4/1996 Lane
5,518,371 A 5/1996 Wellstein
5,519,848 A 5/1996 Wloka
5,520,517 A 5/1996 Sipin
5,540,555 A 7/1996 Corso et al.
D372,719 S 8/1996 Jensen
5,545,012 A 8/1996 Anastos et al.
5,548,854 A 8/1996 Bloemer et al.
5,550,753 A 8/1996 Tompkins et al.
5,559,762 A 9/1996 Sakamoto
D375,908 S 11/1996 Schumaker
5,570,481 A 11/1996 Mathis et al.
5,571,000 A 11/1996 Zimmermann
5,577,890 A 11/1996 Nielsen et al.
5,580,221 A 12/1996 Triezenberg
5,598,080 A 1/1997 Jensen
5,604,491 A 2/1997 Coonley et al.
5,614,812 A 3/1997 Wagoner
5,626,464 A 5/1997 Schoenmeyr
5,628,896 A 5/1997 Klingenberger
5,633,540 A 5/1997 Moan
5,654,504 A 8/1997 Smith
5,672,050 A 9/1997 Webber et al.
5,682,624 A 11/1997 Ciochetti
5,690,476 A 11/1997 Miller
5,711,483 A 1/1998 Hays
5,713,320 A 2/1998 Pfaff et al.
5,272,933 A 3/1998 Laskaris et al.
5,727,933 A 3/1998 Laskaris
5,730,861 A 3/1998 Sterghos et al.
5,731,673 A 3/1998 Gilmore
5,739,648 A 4/1998 Ellis et al.
5,744,921 A 4/1998 Makaran
5,754,421 A 5/1998 Nystrom
5,767,606 A 6/1998 Bresolin
5,777,833 A 7/1998 Romillon 5,791,882 A 8/1998 Stucker
5,804,080 A 9/1998 Klingenberger
5,819,848 A 10/1998 Rasmuson
5,820,350 A 10/1998 Mantey et al.
5,828,200 A 10/1998 Ligman et al.
5,833,437 A 11/1998 Kurth et al.
5,836,271 A 11/1998 Sasaki
5,863,185 A 1/1999 Cochimin et al.
5,883,489 A 3/1999 Konrad
5,894,609 A 4/1999 Barnett
5,907,281 A 5/1999 Miller, Jr. et al.
5,909,352 A 6/1999 Klabunde
5,909,372 A 6/1999 Thybo
5,914,881 A 6/1999 Trachier
5,920,264 A 7/1999 Kim et al.
5,930,092 A 7/1999 Nystrom
5,941,690 A 8/1999 Lin
5,945,802 A 8/1999 Konrad
5,947,689 A 9/1999 Schick
5,947,700 A 9/1999 McKain et al.
5,959,534 A 9/1999 Campbell et al.
5,961,291 A 10/1999 Sakagami
5,969,958 A 10/1999 Nielsen
5,973,465 A 10/1999 Rayner
5,983,146 A 11/1999 Sarbach
5,991,939 A 11/1999 Mulvey
6,030,180 A 2/2000 Clarey et al.
6,037,742 A 3/2000 Rasmussen
6,043,461 A 3/2000 Holling et al.
6,045,331 A 4/2000 Gehm et al.
6,045,333 A 4/2000 Breit
6,046,492 A 4/2000 Machida
6,048,183 A 4/2000 Meza
6,059,536 A 5/2000 Stingl
6,065,946 A 5/2000 Lathrop
6,072,291 A 6/2000 Pedersen
6,091,604 A 7/2000 Plougsgaard
D429,699 S 8/2000 Davis
D429,700 S 8/2000 Liebig
6,098,654 A 8/2000 Cohen et al.
6,102,665 A 8/2000 Centers
6,110,322 A 8/2000 Teoh
6,116,040 A 9/2000 Stark
6,121,746 A 9/2000 Fisher et al.
6,125,481 A 10/2000 Sicilano
6,142,741 A 11/2000 Nishihata
6,157,304 A 12/2000 Bennett et al.
6,171,073 B1 1/2001 McKain et al.
6,178,393 B1 1/2001 Irvin
6,199,224 B1 3/2001 Versland
6,208,112 B1 3/2001 Jensen
6,227,808 B1 5/2001 McDonough
6,238,188 B1 5/2001 Lifson
6,249,435 B1 6/2001 Vicente et al.
6,253,227 B1 6/2001 Tompkins et al.
D445,405 S 7/2001 Schneider
6,254,353 B1 7/2001 Polo
6,257,304 B1 7/2001 Jacobs et al.
6,259,617 B1 7/2001 Wu
6,264,431 B1 7/2001 Triezenberg
6,264,432 B1 7/2001 Kilayko et al.
6,280,611 B1 8/2001 Henkin et al.
6,299,414 B1 10/2001 Schoenmeyr
6,299,699 B1 10/2001 Porat et al.
6,326,752 B1 12/2001 Jensen
6,330,525 B1 12/2001 Hays
6,342,841 B1 1/2002 Stingl
6,349,268 B1 2/2002 Ketonen et al.
6,351,359 B1 2/2002 Jaeger
6,354,805 B1 3/2002 Moller
6,362,591 B1 3/2002 Moberg
6,364,621 B1 4/2002 Yamauchi
6,373,204 B1 4/2002 Peterson
6,373,728 B1 4/2002 Aarestrup
6,380,707 B1 4/2002 Rosholm
6,388,642 B1 5/2002 Cotis
6,390,781 B1 5/2002 McDonough
6,399,781 B1 5/2002 McDonough
6,406,265 B1 6/2002 Hahn
6,415,808 B2 7/2002 Joshi
6,416,295 B1 7/2002 Nagai
6,426,633 B1 7/2002 Thybo
6,447,446 B1 9/2002 Smith et al.
6,450,771 B1 9/2002 Centers
6,464,464 B2 10/2002 Sabini
6,468,042 B2 10/2002 Moller
6,468,052 B2 10/2002 McKain et al.
6,474,949 B1 11/2002 Arai
6,481,973 B1 11/2002 Struthers
6,483,278 B2 11/2002 Harvest
6,483,378 B2 11/2002 Blodgett
6,493,227 B2 12/2002 Nielsen et al.
6,501,629 B1 12/2002 Marriott
6,504,338 B1 1/2003 Eichorn
6,522,034 B1 2/2003 Nakayama
6,534,940 B2 3/2003 Bell et al.
6,534,947 B2 3/2003 Johnson et al.
6,537,032 B1 3/2003 Horiuchi
6,548,976 B2 4/2003 Jensen
6,571,807 B2 6/2003 Jones
6,591,697 B2 7/2003 Henyan
6,604,909 B2 8/2003 Schoenmeyr
6,623,245 B2 9/2003 Meza
6,628,840 B1 9/2003 Aschenbrenner
6,636,135 B1 10/2003 Vetter
D482,664 S 11/2003 Hunt
6,651,900 B1 11/2003 Yoshida
6,672,147 B1 1/2004 Mazet
6,676,831 B2 1/2004 Wolfe
6,690,250 B2 2/2004 Moller
6,696,676 B1 2/2004 Graves et al.
6,709,240 B1 3/2004 Schmalz et al.
6,709,241 B2 3/2004 Sabini
6,709,575 B1 3/2004 Verdegan
6,715,996 B2 4/2004 Moeller
6,717,318 B1 4/2004 Mathiassen
6,732,387 B1 5/2004 Waldron
D490,726 S 6/2004 Eungprabhanth
6,747,367 B2 6/2004 Cline
6,770,043 B1 8/2004 Kahn
6,774,664 B2 8/2004 Godbersen
6,776,584 B2 8/2004 Sabini
6,799,950 B2 10/2004 Meier et al.
6,806,677 B2 10/2004 Kelly et al.
6,837,688 B2 1/2005 Kimberlin et al.
6,842,117 B2 1/2005 Keown
6,847,854 B2 1/2005 Discenzo
6,863,502 B2 3/2005 Bishop et al.
6,875,961 B1 4/2005 Collins
6,884,022 B2 4/2005 Albright
D504,900 S 5/2005 Wang
D505,429 S 5/2005 Wang
6,888,537 B2 5/2005 Benson et al.
D507,243 S 7/2005 Miller
6,925,823 B2 8/2005 Lifson
6,933,693 B2 8/2005 Schuchmann
6,941,785 B2 9/2005 Haynes et al.
D511,530 S 11/2005 Wang
D512,026 S 11/2005 Nurmi
6,965,815 B1 11/2005 Tompkins et al.
6,966,967 B2 11/2005 Curry
D512,440 S 12/2005 Wang
6,976,052 B2 12/2005 Tompkins et al.
D513,737 S 1/2006 Riley
6,981,399 B1 1/2006 Nybo
6,984,158 B2 1/2006 Satoh
6,989,649 B2 1/2006 Mehlhorn
6,993,414 B2 1/2006 Shah
7,005,818 B2 2/2006 Jensen
7,040,107 B2 5/2006 Lee et al.
7,050,278 B2 5/2006 Poulsen
7,080,508 B2 7/2006 Stavale
7,083,392 B2 8/2006 Meza
7,112,037 B2 9/2006 Sabini
7,114,926 B2 10/2006 Oshita
7,117,120 B2 10/2006 Beck et al.
D533,512 S 12/2006 Nakashima
7,183,741 B2 2/2007 Mehlhorn

| | | | |
|---|---|---|---|
| 7,195,462 | B2 | 3/2007 | Nybo |
| 7,221,121 | B2 | 5/2007 | Skaug |
| 7,244,106 | B2 | 7/2007 | Kallman |
| D562,349 | S | 2/2008 | Bulter |
| D567,189 | S | 4/2008 | Stiles, Jr. |
| D582,797 | S | 12/2008 | Fraser |
| D583,828 | S | 12/2008 | Li |
| 7,542,251 | B2 | 6/2009 | Ivankovic |
| 7,690,897 | B2 | 4/2010 | Branecky |
| 7,777,435 | B2 | 8/2010 | Aguilar |
| 7,821,215 | B2 | 10/2010 | Koehl |
| 7,874,808 | B2 | 1/2011 | Stiles |
| 2001/0041139 | A1 | 11/2001 | Sabini et al. |
| 2002/0010839 | A1 | 1/2002 | Tirumala et al. |
| 2002/0018721 | A1 | 2/2002 | Kobayashi |
| 2002/0032491 | A1 | 3/2002 | Imamura et al. |
| 2002/0050490 | A1 | 5/2002 | Pittman |
| 2002/0070875 | A1 | 6/2002 | Crumb |
| 2002/0082727 | A1 | 6/2002 | Laflamme et al. |
| 2002/0131866 | A1 | 9/2002 | Phillips |
| 2002/0136642 | A1 | 9/2002 | Moller |
| 2002/0150476 | A1 | 10/2002 | Lucke et al. |
| 2002/0176783 | A1 | 11/2002 | Moeller |
| 2002/0190687 | A1 | 12/2002 | Bell et al. |
| 2003/0017055 | A1 | 1/2003 | Fong |
| 2003/0034284 | A1 | 2/2003 | Wolfe |
| 2003/0061004 | A1 | 3/2003 | Discenzo |
| 2003/0063900 | A1 | 4/2003 | Wang et al. |
| 2003/0099548 | A1 | 5/2003 | Meza |
| 2003/0106147 | A1 | 6/2003 | Cohen et al. |
| 2003/0174450 | A1 | 9/2003 | Nakajima et al. |
| 2003/0196942 | A1 | 10/2003 | Jones |
| 2004/0000525 | A1 | 1/2004 | Hornsby |
| 2004/0006486 | A1 | 1/2004 | Schmidt et al. |
| 2004/0009075 | A1 | 1/2004 | Meza |
| 2004/0013531 | A1 | 1/2004 | Curry et al. |
| 2004/0016241 | A1 | 1/2004 | Street |
| 2004/0025244 | A1 | 2/2004 | Loyd et al. |
| 2004/0055363 | A1 | 3/2004 | Bristol |
| 2004/0062658 | A1 | 4/2004 | Beck et al. |
| 2004/0090197 | A1 | 5/2004 | Schuchmann |
| 2004/0117330 | A1 | 6/2004 | Ehlers et al. |
| 2004/0149666 | A1 | 8/2004 | Leaverton |
| 2004/0265134 | A1 | 12/2004 | Iimura |
| 2005/0050908 | A1 | 3/2005 | Lee et al. |
| 2005/0095150 | A1 | 5/2005 | Leone et al. |
| 2005/0123408 | A1 | 6/2005 | Koehl |
| 2005/0137720 | A1 | 6/2005 | Spira et al. |
| 2005/0170936 | A1 | 8/2005 | Quinn |
| 2005/0180868 | A1 | 8/2005 | Miller |
| 2005/0190094 | A1 | 9/2005 | Andersen |
| 2005/0193485 | A1 | 9/2005 | Wolfe |
| 2005/0226731 | A1 | 10/2005 | Mehlhorn |
| 2005/0235732 | A1 | 10/2005 | Rush |
| 2005/0260079 | A1 | 11/2005 | Allen |
| 2006/0045750 | A1 | 3/2006 | Stiles |
| 2006/0045751 | A1 | 3/2006 | Beckman et al. |
| 2006/0090255 | A1 | 5/2006 | Cohen |
| 2006/0127227 | A1 | 6/2006 | Mehlhorn |
| 2006/0138033 | A1 | 6/2006 | Hoal |
| 2006/0146462 | A1 | 7/2006 | McMillian, IV |
| 2006/0169322 | A1 | 8/2006 | Torkelson |
| 2006/0204367 | A1 | 9/2006 | Meza |
| 2007/0001635 | A1 | 1/2007 | Ho |
| 2007/0041845 | A1 | 2/2007 | Freudenberger |
| 2007/0061051 | A1 | 3/2007 | Maddox |
| 2007/0113647 | A1 | 5/2007 | Mehlhorn |
| 2007/0114162 | A1 | 5/2007 | Stiles et al. |
| 2007/0124321 | A1 | 5/2007 | Szydlo |
| 2007/0154319 | A1 | 7/2007 | Stiles |
| 2007/0154320 | A1 | 7/2007 | Stiles |
| 2007/0154321 | A1 | 7/2007 | Stiles, Jr. |
| 2007/0154322 | A1 | 7/2007 | Stiles |
| 2007/0154323 | A1 | 7/2007 | Stiles |
| 2007/0160480 | A1 | 7/2007 | Ruffo |
| 2007/0163929 | A1 | 7/2007 | Stiles et al. |
| 2007/0183902 | A1 | 8/2007 | Stiles |
| 2007/0187185 | A1 | 8/2007 | Abraham et al. |
| 2007/0212210 | A1 | 9/2007 | Kernan et al. |
| 2007/0212229 | A1 | 9/2007 | Stavale et al. |
| 2007/0212230 | A1 | 9/2007 | Stavale et al. |
| 2008/0003114 | A1 | 1/2008 | Levin et al. |
| 2008/0039977 | A1 | 2/2008 | Clark |
| 2008/0041839 | A1 | 2/2008 | Tran |
| 2008/0063535 | A1 | 3/2008 | Koehl |
| 2008/0095638 | A1 | 4/2008 | Branecky |
| 2008/0131286 | A1 | 6/2008 | Koehl |
| 2008/0131289 | A1 | 6/2008 | Koehl |
| 2008/0131291 | A1 | 6/2008 | Koehl |
| 2008/0131294 | A1 | 6/2008 | Koehl |
| 2008/0131295 | A1 | 6/2008 | Koehl |
| 2008/0131296 | A1 | 6/2008 | Koehl |
| 2008/0140353 | A1 | 6/2008 | Koehl |
| 2008/0152508 | A1 | 6/2008 | Meza |
| 2008/0095639 | A1 | 7/2008 | Caudill et al. |
| 2008/0168599 | A1 | 7/2008 | Caudill |
| 2008/0181785 | A1 | 7/2008 | Koehl |
| 2008/0181786 | A1 | 7/2008 | Meza |
| 2008/0181787 | A1 | 7/2008 | Koehl |
| 2008/0181788 | A1 | 7/2008 | Meza |
| 2008/0181789 | A1 | 7/2008 | Koehl |
| 2008/0181790 | A1 | 7/2008 | Meza |
| 2008/0189885 | A1 | 8/2008 | Erlich |
| 2008/0260540 | A1 | 10/2008 | Koehl |
| 2008/0288115 | A1 | 11/2008 | Rusnak et al. |
| 2009/0014044 | A1 | 1/2009 | Hartman |
| 2009/0104044 | A1 | 4/2009 | Koehl |
| 2009/0204237 | A1 | 8/2009 | Sustaeta |
| 2009/0204267 | A1 | 8/2009 | Sustaeta |
| 2009/0210081 | A1 | 8/2009 | Sustaeta |
| 2010/0306001 | A1 | 12/2010 | Discenzo |
| 2011/0044823 | A1 | 2/2011 | Stiles |
| 2011/0052416 | A1 | 3/2011 | Stiles |
| 2012/0020810 | A1 | 1/2012 | Stiles, Jr. |
| 2012/0100010 | A1 | 4/2012 | Stiles, Jr. |

FOREIGN PATENT DOCUMENTS

| | | |
|---|---|---|
| DE | 19645129 | 5/1998 |
| DE | 10231773 | 2/2004 |
| DE | 19938490 | 4/2005 |
| EP | 246769 | 5/1986 |
| EP | 0306814 | 3/1989 |
| EP | 0314249 | 5/1989 |
| EP | 0709575 | 5/1996 |
| EP | 833436 | 9/1996 |
| EP | 0735273 | 10/1996 |
| EP | 0831188 | 3/1998 |
| EP | 0978657 | 2/2000 |
| EP | 1134421 | 9/2001 |
| FR | 2529965 | 6/1983 |
| FR | 2703409 | 10/1994 |
| GB | 2124304 | 6/1983 |
| JP | 5010270 | 1/1993 |
| WO | WO98/04835 | 2/1998 |
| WO | WO00/42339 | 7/2000 |
| WO | WO 01/47099 | 6/2001 |
| WO | WO03/099705 | 12/2003 |
| WO | WO 2004/006416 | 1/2004 |
| WO | WO2004/073772 | 9/2004 |
| WO | WO 2004/088694 | 10/2004 |
| WO | WO 2006/069568 | 7/2006 |

OTHER PUBLICATIONS

Pentair Pool Products; "IntelliFlo 4X160 a Breathrough in Energy-Efficiency and Service Life;" pp. 1-4; Nov. 2005; www/pentairpool.com.

Pentair Water Pool and Spa, Inc.; "The Pool Pro's Guide to Breakthrough Efficiency, Convenience & Profitability;" pp. 1-8; Mar. 2006; wwwpentairpool.com.

Grundfos Pumps Corporation; "The New Standard in Submersible Pumps;" Brochure; pp. 1-8; Jun. 1999; Fresno, CA USA.

Grundfos Pumps Corporation; "Grundfos SQ/SQE Data Book;" pp. 1-39; Jun. 1999; Fresno, CA USA.

Goulds Pumps; "Balanced Flow System Brochure;" pp. 1-4; 2001.

Goulds Pumps; "Balanced Flow Submersible System Installation, Operation & Trouble-Shooting Manual;" pp. 1-9; 2000; USA.

Goulds Pumps; "Balanced Flow System Variable Speed Submersible Pump" Specification Sheet; pp. 1-2; Jan. 2000; USA.
Goulds Pumps; Advertisement from "Pumps & Systems Magazine;" Jan. 2002; Seneca Falls, NY.
Goulds Pumps; "Hydro-Pro Water System Tank Installation, Operation & Maintenance Instructions;" pp. 1-30; Mar. 31, 2001; Seneca Falls, NY USA.
Goulds Pumps; "Pumpsmart Control Solutions" Advertisement from Industrial Equipment News; Aug. 2002; New York, NY USA.
Goulds Pumps; "Model BFSS List Price Sheet;" Feb. 5, 2001.
Goulds Pumps; "Balanced Flow System Model BFSS Variable Speed Submersible Pump System" Brochure; pp. 1-4; Jan. 2001; USA.
Goulds Pumps; "Balanced Flow System Model BFSS Variable Speed Submersible Pump" Brochure; pp. 1-3; Jan. 2000; USA.
Amtrol Inc.; "Amtrol Unearths the Facts About Variable Speed Pumps and Constant Pressure Valves;" pp. 1-5; Aug. 2002; West Warwick, RI USA.
Franklin Electric; "CP Water-Subdrive 75 Constant Pressure Controller" Product Data Sheet; May 2001; Bluffton, IN USA.
Franklin Electric; "Franklin Aid, Subdrive 75: You Made It Better;" vol. 20, No. 1; pp. 1-2; Jan./Feb. 2002; www.franklin-electric.com.
Email Regarding Grundfos' Price Increases/SQ/QE Curves; pp. 1-7; Dec. 19, 2001.
F.E. Myers; "Featured Product: F.E. Myers Introducts Revolutionary Constant Pressure Water System;" pp. 1-8; Jun. 28, 2000; Ashland, OH USA.
"Water Pressure Problems" Published Article; The American Well Owner; No. 2, Jul. 2000.
"Understanding Constant Pressure Control;" pp. 1-3; Nov. 1, 1999.
"Constant Pressure is the Name of the Game;" Published Article from National Driller; Mar. 2001.
SJE-Rhombus; "Variable Frequency Drives for Constant Pressure Control;" Aug. 2008; pp. 1-4; Detroit Lakes, MN USA.
SJE-Rhombus; "Constant Pressure Controller for Submersible Well Pumps;" Jan. 2009; pp. 1-4; Detroit Lakes, MN USA.
SJE-Rhombus; "SubCon Variable Frequency Drive;" Dec. 2008; pp. 1-2; Detroit Lakes, MN USA.
Grundfos; "SmartFlo SQE Constant Pressure System;" Mar. 2002; pp. 1-4; Olathe, KS USA.
Grundfos; "Grundfos SmartFlo SQE Constant Pressure System;" Mar. 2003; pp. 1-2; USA.
Grundfos; "CU301 Installation & Operating Instructions;" Sep. 2005; pp. 1-30; Olathe, KS USA.
ITT Corporation; "Goulds Pumps Balanced Flow Submersible Pump Controller;" Jul. 2007; pp. 1-12.
ITT Corporation; "Goulds Pumps Balanced Flow;" Jul. 2006; pp. 1-8.
ITT Corporation; "Goulds Pumps Balanced Flow Constant Pressure Controller for 2 HP Submersible Pumps;" Jun. 2005; pp. 1-4 USA.
ITT Corporation; "Goulds Pumps Balanced Flow Constant Pressure Controller for 3 HP Submersible Pumps;" Jun. 2005; pp. 1-4; USA.
Franklin Electric; Constant Pressure in Just the Right Size; Aug. 2006; pp. 1-4; Bluffton, IN USA.
Franklin Electric; "Franklin Application Installation Data;" vol. 21, No. 5, Sep./Oct. 2003; pp. 1-2; www.franklin-electric.com.
Franklin Electric; "Monodrive MonodriveXT Single-Phase Constant Pressure;" Sep. 2008; pp. 1-2; Bluffton, IN USA.
Danfoss; "VLT8000 Aqua Instruction Manual;" Apr. 16, 2004; pp. 1-71.
"Product Focus—New AC Drive Series Targets Water, Wastewater Applications;" WaterWorld Articles; Jul. 2002; pp. 1-2.
Pentair; "Pentair IntelliTouch Operating Manual;" May 22, 2003; pp. 1-60.
Pentair; "Pentair RS-485 Pool Controller Adapter" Published Advertisement; Mar. 22, 2002; pp. 1-2.
Compool; "Compool CP3800 Pool-Spa Control System Installation and Operating Instructions;" Nov. 7, 1997; pp. 1-45.
Hayward; "Hayward Pro-Series High-Rate Sand Filter Owner's Guide;" 2002; pp. 1-4.
Danfoss; "Danfoss VLT 6000 Series Adjustable Frequency Drive Installation, Operation and Maintenance Manual;" Mar. 2000; pp. 1-118.
54DX16-Hayward EcoStar Technical Guide (Version2); 2011; pp. 1-51; cited in Civil Action 5:11-cv-00459D.
54DX18-STMicroelectronics; "AN1946—Sensorless BLDC Motor Control & BEMF Sampling Methods with ST7MC;" 2007; pp. 1-35; Civil Action 5:11-cv-00459D.
54DX19-STMicroelectronics; "AN1276 BLDC Motor Start Routine for ST72141 Microcontroller;" 2000; pp. 1-18; cited in Civil Action 5:11-cv-00459D.
54DX21-Danfoss; "VLT 8000 Aqua Instruction Manual;" Apr. 2004; 1-210; Cited in Civil Action 5:11-cv-00459D.
54DX23-Commander; "Commander SE Advanced User Guide;" Nov. 2002; pp. 1-190; cited in Civil Action 5:11-cv-00459D.
54DX30-Sabbagh et al.; "A Model for Optimal . . . Control of Pumping Stations in Irrigation Systems;" Jul. 1988; NL pp. 119-133; Civil Action 5:11-cv-00459D.
54DX31-Danfoss; "VLT 5000 FLUX Aqua DeviceNet Instruction Manual;" Apr. 28, 2003; pp. 1-39; cited in Civil Action 5:11-cv-00459D.
54DX32-Danfoss; "VLT 5000 FLUX Aqua Profibus Operating Instructions;" May 22, 2003; 1-64; cited in Civil Action 5:11-cv-00459D.
54DX33-Pentair; "IntelliTouch Owner's Manual Set-Up & Programming;" May 22, 2003; Sanford, NC; pp. 1-61;cited in Civil Action 5:11-cv-00459D.
54DX34-Pentair; "Compool 3800 Pool-Spa Control System Installation & Operating Instructions;" Nov. 7, 1997; pp. 1-45; cited in Civil Action 5:11-cv-00459D.
54DX35-Pentair Advertisement in "Pool & Spa News;" Mar. 22, 2002; pp. 1-3; cited in Civil Action 5:11-cv-00459D.
54DX36-Hayward; "Pro-Series High-Rate Sand Filter Owner's Guide;" 2002; Elizabeth, NJ; pp. 1-5; cited in Civil Action 5:11-cv-00459D.
54DX37-Danfoss; "VLT 8000 Aqua Fact Sheet;" Jan. 2002; pp. 1-3; cited in Civil Action 5:11-cv-00459D.
54DX38-Danfoss; "VLT 6000 Series Installation, Operation & Maintenance Manual;" Mar. 2000; pp. 1-118; cited in Civil Action 5:11-cv-00459D.
9PX6-Pentair; "IntelliFlo Variable Speed Pump" Brochure; 2011; pp. 1-9; cited in Civil Action 5:11-cv-00459D.
9PX7-Pentair; "IntelliFlo Vf Intelligent Variable Flow Pump;" 2011; pp. 1-9; cited in Civil Action 5:11-cv-00459D.
9PX8-Pentair; "IntelliFlo VS+SVRS Intelligent Variable Speed Pump;" 2011; pp. 1-9; cited in Civil Action 5:11-cv-00459D.
9PX9-STA-RITE; "IntelliPro Variable Speed Pump;" 2011; pp. 1-9; cited in Civil Action 5:11-cv-00459D.
9PX14-Pentair; "IntelliFlo Installation and User's Guide;" pp. 1-53; Jul. 26, 2011; Sanford, NC; cited in Civil Action 5:11-cv-00459D.
PX-138-Deposition of Dr. Douglas C. Hopkins; pp. 1-391; 2011; taken in Civil Action 10-cv-1662.
PX-141-Danfoss; "Whitepaper Automatic Energy Optimization;" pp. 1-4; 2011; cited in Civil Action 5:11-cv-00459.
9PX10-Pentair; "IntelliPro VS+SVRS Intelligent Variable Speed Pump;" 2011; pp. 1-6; cited in Civil Action 5:11-cv-00459D.
9PX11-Pentair; "IntelliTouch Pool & Spa Control Control Systems;" 2011; pp. 1-5; cited in Civil Action 5:11-cv-00459D.

* cited by examiner

PUMPING SYSTEM WITH POWER OPTIMIZATION

RELATED APPLICATIONS

This application is a divisional of U.S. application Ser. No. 11/609,029, filed Dec. 11, 2006, now U.S. Pat. No. 7,686,589 which is a continuation-in-part of U.S. application Ser. No. 10/926,513, filed Aug. 26, 2004, now U.S. Pat. No. 7,874,808 and U.S. application Ser. No. 11/286,888, filed Nov. 23, 2005, now U.S. Pat. No. 8,019,479 the entire disclosures of which are hereby incorporated herein by reference.

FIELD OF THE INVENTION

The present invention relates generally to control of a pump, and more particularly to control of a variable speed pumping system for a pool.

BACKGROUND OF THE INVENTION

Conventionally, a pump to be used in a pool is operable at a finite number of predetermined speed settings (e.g., typically high and low settings). Typically these speed settings correspond to the range of pumping demands of the pool at the time of installation. Factors such as the volumetric flow rate of water to be pumped, the total head pressure required to adequately pump the volume of water, and other operational parameters determine the size of the pump and the proper speed settings for pump operation. Once the pump is installed, the speed settings typically are not readily changed to accommodate changes in the pool conditions and/or pumping demands.

Installation of the pump for an aquatic application such as a pool entails sizing the pump to meet the pumping demands of that particular pool and any associated features. Because of the large variety of shapes and dimensions of pools that are available, precise hydraulic calculations must be performed by the installer, often on-site, to ensure that the pumping system works properly after installation. The hydraulic calculations must be performed based on the specific characteristics and features of the particular pool, and may include assumptions to simplify the calculations for a pool with a unique shape or feature. These assumptions can introduce a degree of error to the calculations that could result in the installation of an unsuitably sized pump. Essentially, the installer is required to install a customized pump system for each aquatic application.

A plurality of aquatic applications at one location requires a pump to elevate the pressure of water used in each application. When one aquatic application is installed subsequent to a first aquatic application, a second pump must be installed if the initially installed pump cannot be operated at a speed to accommodate both aquatic applications. Similarly, features added to an aquatic application that use water at a rate that exceeds the pumping capacity of an existing pump will need an additional pump to satisfy the demand for water. As an alternative, the initially installed pump can be replaced with a new pump that can accommodate the combined demands of the aquatic applications and features.

During use, it is possible that a conventional pump is manually adjusted to operate at one of the finite speed settings. However, adjusting the pump to one of the settings may cause the pump to operate at a rate that exceeds a needed rate, while adjusting the pump to another setting may cause the pump to operate at a rate that provides an insufficient amount of flow and/or pressure. In such a case, the pump will either operate inefficiently or operate at a level below that which is desired. Additionally, where varying water demands are required for multiple aquatic applications, the water movement associated with such other applications can be utilized as part of an overall water movement to achieve desired values. As such, a reduction in energy consumption can be achieved by determining an overall water movement within the pool, and varying operation of the pump accordingly.

Accordingly, it would be beneficial to provide a pump that could be readily and easily adapted to provide a suitably supply of water at a desired pressure to aquatic applications having a variety of sizes and features. The pump should be customizable on-site to meet the needs of the particular aquatic application and associated features, capable of pumping water to a plurality of aquatic applications and features, and should be variably adjustable over a range of operating speeds to pump the water as needed when conditions change. Further, the pump should be responsive to a change of conditions and/or user input instructions.

SUMMARY OF THE INVENTION

In accordance with one aspect, the present invention provides a pumping system for moving water of a swimming pool, including a water pump for moving water in connection with performance of an operation upon the water; and a variable speed motor operatively connected to drive the pump. The pumping system further includes means for providing a target volume amount of water to be moved by the water pump, means for providing an operational time period for the pump, and means for determining a volume of water moved by the pump during the operational time period. The pumping system further includes means for altering the operational time period based upon the volume of water moved during the operational time period.

In accordance with another aspect, the present invention provides a pumping system for moving water of a swimming pool, including a water pump for moving water in connection with performance of an operation upon the water and a variable speed motor operatively connected to drive the pump. The pumping system further includes means for providing a target volume amount of water to be moved by the water pump, means for determining a volume of water moved by the pump, and means for altering operation of the motor when the volume of water moved by the pump exceeds the target volume amount.

In accordance with another aspect, the present invention provides a pumping system for moving water of a swimming pool, including a water pump for moving water in connection with performance of an operation upon the water, and a variable speed motor operatively connected to drive the pump. The pumping system further includes means for providing a target volume amount of water to be moved by the water pump, means for providing a time period value, and means for determining a target flow rate of water to be moved by the water pump based upon the target volume amount and time period value. The pumping system further includes means for controlling the motor to adjust the flow rate of water moved by the pump to the target flow rate.

In accordance with yet another aspect, the present invention provides a pumping system for moving water of a swimming pool, including a water pump for moving water in connection with performance of an operation upon the water, and a variable speed motor operatively connected to drive the pump. The pumping system further includes means for providing a target volume amount of water to be moved by the water pump, means for performing a first operation upon the moving water, the first operation moving the water at a first flow rate during a first time period, and means for performing a second operation upon the moving water, the second operation moving the water at a second flow rate during a second time period. The pumping system further includes means for determining a first volume of water moved by the pump during the first time period, means for determining a second volume of water moved by the pump during the second time period. The pumping system further includes means for determining a total volume of water moved by the pump based upon the first and second volumes, and means for altering operation of the motor when the total volume of water moved by the pump exceeds the target volume amount.

In accordance with still yet another aspect, the present invention provides a pumping system for moving water of a swimming pool, including a water pump for moving water in connection with performance of an operation upon the water, and a variable speed motor operatively connected to drive the pump. The pumping system further includes means for providing a target volume amount of water to be moved by the water pump, means for providing a range of time period values, and means for determining a range of flow rate values of water to be moved by the water pump based upon the target volume amount and time period values, each flow rate value being associated with a time period value. The pumping system further includes means for determining a range of motor speed values based upon the flow rate values, each motor speed value being associated with a flow rate value, and means for determining a range of power consumption values of the motor based upon the motor speed values, each power consumption value being associated with a motor speed value. The pumping system further includes means for determining an optimized flow rate value that is associated with the lowest power consumption value, and means for controlling the motor to adjust the flow rate of water moved by the pump to the optimized flow rate value.

BRIEF DESCRIPTION OF THE DRAWINGS

The foregoing and other features and advantages of the present invention will become apparent to those skilled in the art to which the present invention relates upon reading the following description with reference to the accompanying drawings, in which.

DESCRIPTION OF EXAMPLE EMBODIMENTS

Figure 1:
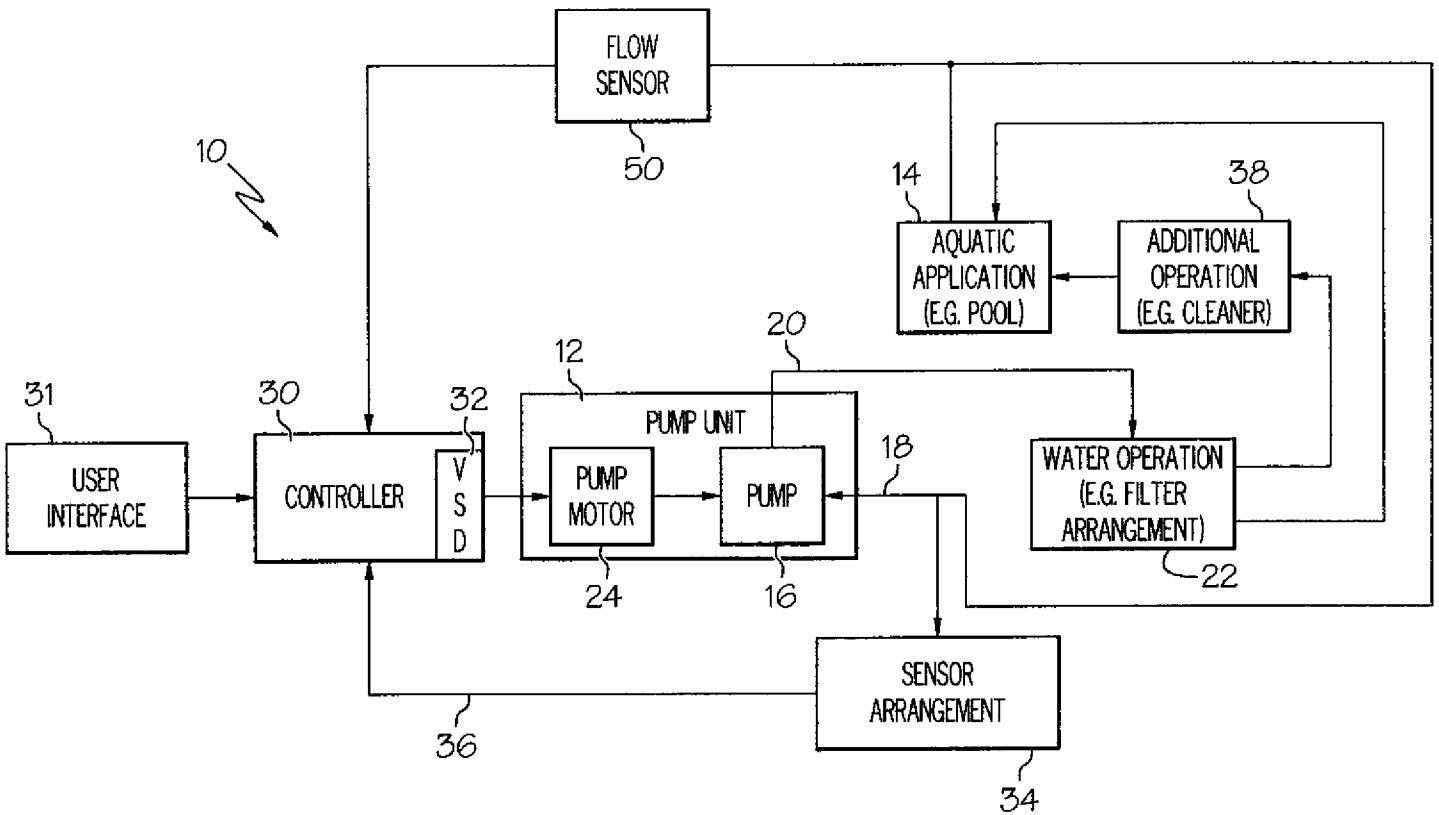
FIG. 1 is a block diagram of an example of a variable speed pumping system in a pool environment in accordance with the present invention.

Certain terminology is used herein for convenience only and is not to be taken as a limitation on the present invention. Further, in the drawings, the same reference numerals are employed for designating the same elements throughout the figures, and in order to clearly and concisely illustrate the present invention, certain features may be shown in somewhat schematic form.

An example variable-speed pumping system 10 in accordance with one aspect of the present invention is schematically shown in FIG. 1. The pumping system 10 includes a pump unit 12 that is shown as being used with a pool 14. It is to be appreciated that the pump unit 12 includes a pump 16 for moving water through inlet and outlet lines 18 and 20.

The swimming pool 14 is one example of a pool. The definition of "swimming pool" includes, but is not limited to, swimming pools, spas, and whirlpool baths. Features and accessories may be associated therewith, such as water jets, waterfalls, fountains, pool filtration equipment, chemical treatment equipment, pool vacuums, spillways and the like.

A water operation 22 is performed upon the water moved by the pump 16. Within the shown example, the water operation 22 is a filter arrangement that is associated with the pumping system 10 and the pool 14 for providing a cleaning operation (i.e., filtering) on the water within the pool. The filter arrangement 22 is operatively connected between the pool 14 and the pump 16 at/along an inlet line 18 for the pump. Thus, the pump 16, the pool 14, the filter arrangement 22, and the interconnecting lines 18 and 20 form a fluid circuit or pathway for the movement of water.

It is to be appreciated that the function of filtering is but one example of an operation that can be performed upon the water. Other operations that can be performed upon the water may be simplistic, complex or diverse. For example, the operation performed on the water may merely be just movement of the water by the pumping system (e.g., re-circulation of the water in a waterfall or spa environment).

Turning to the filter arrangement 22, any suitable construction and configuration of the filter arrangement is possible. For example, the filter arrangement 22 can include a sand filter, a cartridge filter, and/or a diatomaceous earth filter, or the like. In another example, the filter arrangement 22 may include a skimmer assembly for collecting coarse debris from water being withdrawn from the pool, and one or more filter components for straining finer material from the water. In still yet another example, the filter arrangement 22 can be in fluid communication with a pool cleaner, such as a vacuum pool cleaner adapted to vacuum debris from the various submerged surfaces of the pool. The pool cleaner can include various types, such as various manual and/or automatic types.

The pump 16 may have any suitable construction and/or configuration for providing the desired force to the water and move the water. In one example, the pump 16 is a common centrifugal pump of the type known to have impellers extending radially from a central axis. Vanes defined by the impellers create interior passages through which the water passes as the impellers are rotated. Rotating the impellers about the central axis imparts a centrifugal force on water therein, and thus imparts the force flow to the water. Although centrifugal pumps are well suited to pump a large volume of water at a continuous rate, other motor-operated pumps may also be used within the scope of the present invention.

Drive force is provided to the pump 16 via a pump motor 24. In the one example, the drive force is in the form of rotational force provided to rotate the impeller of the pump 16. In one specific embodiment, the pump motor 24 is a permanent magnet motor. In another specific embodiment, the pump motor 24 is an induction motor. In yet another embodiment, the pump motor 24 can be a synchronous or asynchronous motor. The pump motor 24 operation is infinitely variable within a range of operation (i.e., zero to maximum operation). In one specific example, the operation is indicated by the RPM of the rotational force provided to rotate the impeller of the pump 16. In the case of a synchronous motor 24, the steady state speed (RPM) of the motor 24 can be referred to as the synchronous speed. Further, in the case of a synchronous motor 24, the steady state speed of the motor 24 can also be determined based upon the operating frequency in hertz (Hz). Thus, either or both of the pump 16 and/or the motor 24 can be configured to consume power during operation.

A controller 30 provides for the control of the pump motor 24 and thus the control of the pump 16. Within the shown example, the controller 30 includes a variable speed drive 32 that provides for the infinitely variable control of the pump motor 24 (i.e., varies the speed of the pump motor). By way of example, within the operation of the variable speed drive 32, a single phase AC current from a source power supply is converted (e.g., broken) into a three-phase AC current. Any suitable technique and associated construction/configuration may be used to provide the three-phase AC current. The variable speed drive supplies the AC electric power at a changeable frequency to the pump motor to drive the pump motor. The construction and/or configuration of the pump 16, the pump motor 24, the controller 30 as a whole, and the variable speed drive 32 as a portion of the controller 30, are not limitations on the present invention. In one possibility, the pump 16 and the pump motor 24 are disposed within a single housing to form a single unit, and the controller 30 with the variable speed drive 32 are disposed within another single housing to form another single unit. In another possibility, these components are disposed within a single housing to form a single unit.

It is to be appreciated that the controller 30 may have various forms to accomplish the desired functions. In one example, the controller 30 includes a computer processor that operates a program. In the alternative, the program may be considered to be an algorithm. The program may be in the form of macros. Further, the program may be changeable, and the controller 30 is thus programmable. It is to be appreciated that the programming for the controller 30 may be modified, updated, etc. in various manners. It is further to be appreciated that the controller 30 can include either or both of analog and digital components.

Figure 6:
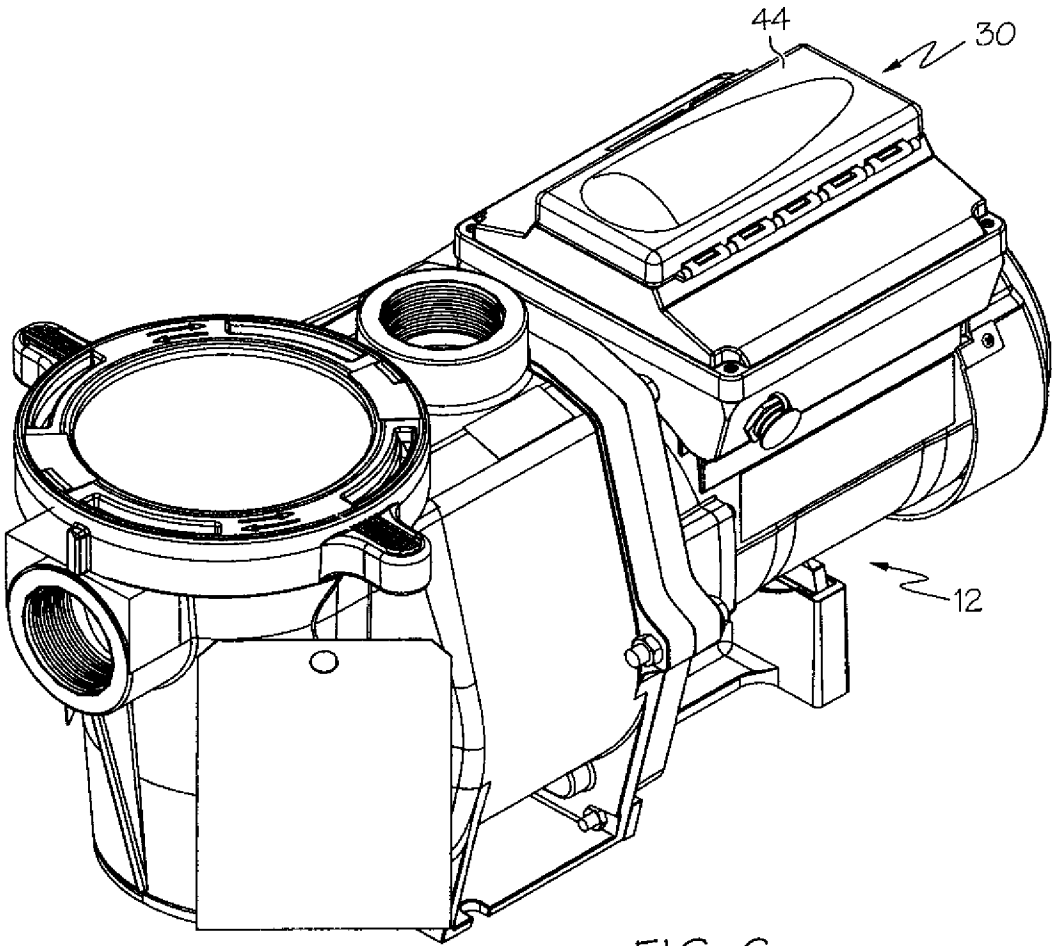
FIG. 6 is a perceptive view of an example pump unit that incorporates one aspect of the present invention.

Further still, the controller 30 can receive input from a user interface 31 that can be operatively connected to the controller in various manners. For example, the user interface 31 can include a keypad 40, buttons, switches, or the like such that a user could input various parameters into the controller 30. In addition or alternatively, the user interface 31 can be adapted to provide visual and/or audible information to a user. For example, the user interface 31 can include one or more visual displays 42, such as an alphanumeric LCD display, LED lights, or the like. Additionally, the user interface 31 can also include a buzzer, loudspeaker, or the like. Further still, as shown in FIG. 6, the user interface 31 can include a removable (e.g., pivotable, slidable, detachable, etc.) protective cover 44 adapted to provide protection against damage when the user interface 31 is not in use. The protective cover 44 can include various rigid or semi-rigid materials, such as plastic, and can have various degrees of light permeability, such as opaque, translucent, and/or transparent.

The pumping system 10 has means used for control of the operation of the pump. In accordance with one aspect of the present invention, the pumping system 10 includes means for sensing, determining, or the like one or more parameters indicative of the operation performed upon the water. Within one specific example, the system includes means for sensing, determining or the like one or more parameters indicative of the movement of water within the fluid circuit.

The ability to sense, determine or the like one or more parameters may take a variety of forms. For example, one or more sensors 34 may be utilized. Such one or more sensors 34 can be referred to as a sensor arrangement. The sensor arrangement 34 of the pumping system 10 would sense one or more parameters indicative of the operation performed upon the water. Within one specific example, the sensor arrangement 34 senses parameters indicative of the movement of water within the fluid circuit. The movement along the fluid circuit includes movement of water through the filter arrangement 22. As such, the sensor arrangement 34 includes at least one sensor used to determine flow rate of the water moving within the fluid circuit and/or includes at least one sensor used to determine flow pressure of the water moving within the fluid circuit. In one example, the sensor arrangement 34 is operatively connected with the water circuit at/adjacent to the location of the filter arrangement 22. It should be appreciated that the sensors of the sensor arrangement 34 may be at different locations than the locations presented for the example. Also, the sensors of the sensor arrangement 34 may be at different locations from each other. Still further, the sensors may be configured such that different sensor portions are at different locations within the fluid circuit. Such a sensor arrangement 34 would be operatively connected 36 to the controller 30 to provide the sensory information thereto.

It is to be noted that the sensor arrangement 34 may accomplish the sensing task via various methodologies, and/or different and/or additional sensors may be provided within the system 10 and information provided therefrom may be utilized within the system. For example, the sensor arrangement 34 may be provided that is associated with the filter arrangement and that senses an operation characteristic associated with the filter arrangement. For example, such a sensor may monitor filter performance. Such monitoring may be as basic as monitoring filter flow rate, filter pressure, or some other parameter that indicates performance of the filter arrangement. Of course, it is to be appreciated that the sensed parameter of operation may be otherwise associated with the operation performed upon the water. As such, the sensed parameter of operation can be as simplistic as a flow indicative parameter such as rate, pressure, etc.

Such indication information can be used by the controller 30, via performance of a program, algorithm or the like, to perform various functions, and examples of such are set forth below. Also, it is to be appreciated that additional functions and features may be separate or combined, and that sensor information may be obtained by one or more sensors.

With regard to the specific example of monitoring flow rate and flow pressure, the information from the sensor arrangement 34 can be used as an indication of impediment or hindrance via obstruction or condition, whether physical, chemical, or mechanical in nature, that interferes with the flow of water from the pool to the pump such as debris accumulation or the lack of accumulation, within the filter arrangement 34. As such, the monitored information can be indicative of the condition of the filter arrangement.

In one example, the flow rate can be determined in a "sensorless" manner from a measurement of power consumption of the motor 24 and/or associated other performance values (e.g., relative amount of change, comparison of changed values, time elapsed, number of consecutive changes, etc.). The change in power consumption can be determined in various ways, such as by a change in power consumption based upon a measurement of electrical current and electrical voltage provided to the motor 24. Various other factors can also be included, such as the power factor, resistance, and/or friction of the motor 24 components, and/or even physical properties of the swimming pool, such as the temperature of the water. It is to be appreciated that in the various implementations of a "sensorless" system, various other variables (e.g., filter loading, flow rate, flow pressure, motor speed, time, etc.) can be either supplied by a user, other system elements, and/or determined from the power consumption.

Figure 2:
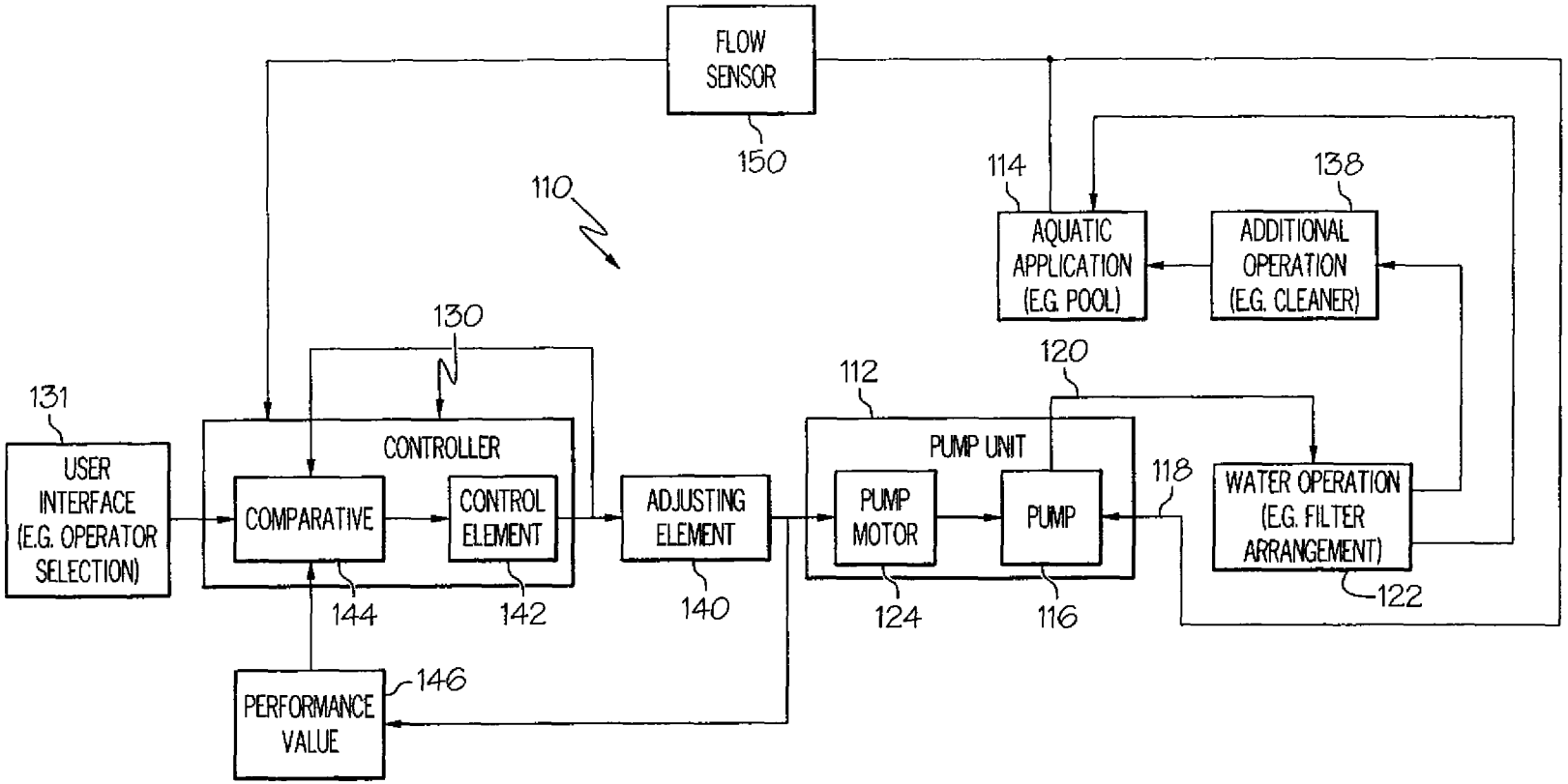
FIG. 2 is another block diagram of another example of a variable speed pumping system in a pool environment in accordance with the present invention.

The example of FIG. 1 shows an example additional operation 38 and the example of FIG. 2 shows an example additional operation 138. Such an additional operation (e.g., 38 or 138) may be a cleaner device, either manual or autonomous. As can be appreciated, an additional operation involves additional water movement. Also, within the presented examples of FIGS. 1 and 2, the water movement is through the filter arrangement (e.g., 22 or 122). Such additional water movement may be used to supplant the need for other water movement.

Within another example (FIG. 2) of a pumping system 110 that includes means for sensing, determining, or the like one or more parameters indicative of the operation performed upon the water, the controller 130 can determine the one or more parameters via sensing, determining or the like parameters associated with the operation of a pump 116 of a pump unit 112. Such an approach is based upon an understanding that the pump operation itself has one or more relationships to the operation performed upon the water.

It should be appreciated that the pump unit 112, which includes the pump 116 and a pump motor 124, a pool 114, a filter arrangement 122, and interconnecting lines 118 and 120, may be identical or different from the corresponding items within the example of FIG. 1. In addition, as stated above, the controller 130 can receive input from a user interface 131 that can be operatively connected to the controller in various manners.

Turning back to the example of FIG. 2, some examples of the pumping system 110, and specifically the controller 130 and associated portions, that utilize at least one relationship between the pump operation and the operation performed upon the water attention are shown in U.S. Pat. No. 6,354,805, to Moller, entitled "Method For Regulating A Delivery Variable Of A Pump" and U.S. Pat. No. 6,468,042, to Moller, entitled "Method For Regulating A Delivery Variable Of A Pump." The disclosures of these patents are incorporated herein by reference. In short summary, direct sensing of the pressure and/or flow rate of the water is not performed, but instead one or more sensed or determined parameters associated with pump operation are utilized as an indication of pump performance. One example of such a pump parameter is input power. Pressure and/or flow rate can be calculated/determined from such pump parameter(s).

Although the system 110 and the controller 130 may be of varied construction, configuration and operation, the function block diagram of FIG. 2 is generally representative. Within the shown example, an adjusting element 140 is operatively connected to the pump motor and is also operatively connected to a control element 142 within the controller 130. The control element 142 operates in response to a comparative function 144, which receives input from one or more performance value(s) 146.

The performance value(s) 146 can be determined utilizing information from the operation of the pump motor 124 and controlled by the adjusting element 140. As such, a feedback iteration can be performed to control the pump motor 124. Also, operation of the pump motor and the pump can provide the information used to control the pump motor/pump. As mentioned, it is an understanding that operation of the pump motor/pump has a relationship to the flow rate and/or pressure of the water flow that is utilized to control flow rate and/or flow pressure via control of the pump.

As mentioned, the sensed, determined (e.g., calculated, provided via a look-up table, graph or curve, such as a constant flow curve or the like, etc.) information can be utilized to determine the various performance characteristics of the pumping system 110, such as input power consumed, motor speed, flow rate and/or the flow pressure. In one example, the operation can be configured to prevent damage to a user or to the pumping system 10, 110 caused by an obstruction. Thus, the controller (e.g., 30 or 130) provides the control to operate the pump motor/pump accordingly. In other words, the controller (e.g., 30 or 130) can repeatedly monitor one or more performance value(s) 146 of the pumping system 10,110, such as the input power consumed by, or the speed of, the pump motor (e.g., 24 or 124) to sense or determine a parameter indicative of an obstruction or the like.

Turning to the issue of operation of the system (e.g., 10 or 110) over a course of a long period of time, it is typical that a predetermined volume of water flow is desired. For example, it may be desirable to move a volume of water equal to the volume within the pool. Such movement of water is typically referred to as a turnover. It may be desirable to move a volume of water equal to multiple turnovers within a specified time period (e.g., a day). Within an example in which the water operation includes a filter operation, the desired water movement (e.g., specific number of turnovers within one day) may be related to the necessity to maintain a desired water clarity.

Within yet another aspect of the present invention, the pumping system 10 may operate to have different constant flow rates during different time periods. Such different time periods may be sub-periods (e.g., specific hours) within an overall time period (e.g., a day) within which a specific number of water turnovers is desired. During some time periods a larger flow rate may be desired, and a lower flow rate may be desired at other time periods. Within the example of a swimming pool with a filter arrangement as part of the water operation, it may be desired to have a larger flow rate during pool-use time (e.g., daylight hours) to provide for increased water turnover and thus increased filtering of the water. Within the same swimming pool example, it may be desired to have a lower flow rate during non-use (e.g., nighttime hours).

Figure 3:
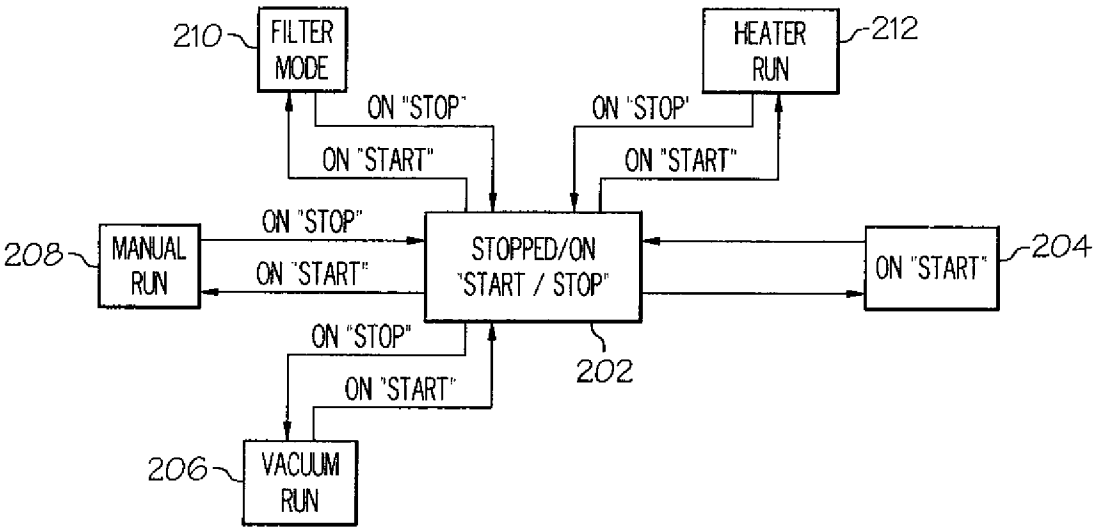
FIG. 3 is function flow chart for an example methodology in accordance with an aspect of the present invention.

Turning to one specific example, attention is directed to the top-level operation chart that is shown in FIG. 3. With the chart, it can be appreciated that the system has an overall ON/OFF status 202 as indicated by the central box. Specifically, overall operation is started 204 and thus the system is ON. However, under the penumbra of a general ON state, a number of water operations can be performed. Within the shown example, the operations are Vacuum run 206, Manual run 208, Filter mode 210, and Heater Run 212.

Briefly, the Vacuum run operation 206 is entered and utilized when a vacuum device is utilized within the pool 14. For example, such a vacuum device is typically connected to the pump 16 possibly through the filter arrangement 22, via a relatively long extent of hose and is moved about the pool 14 to clean the water at various locations and/or the surfaces of the pool at various locations. The vacuum device may be a manually moved device or may autonomously move.

Similarly, the manual run operation 208 is entered and utilized when it is desired to operate the pump outside of the other specified operations. The heater run operation 212 is for operation performed in the course of heating the fluid (e.g., water) pumped by the pumping system 10.

Turning to the filter mode 210, this is a typical operation performed in order to maintain water clarity within the pool 14. Moreover, the filter mode 210 is operated to obtain effective filtering of the pool while minimizing energy consumption. Specifically, the pump is operated to move water through the filter arrangement. It is to be appreciated that the various operations 204-212 can be initiated manually by a user, automatically by the means for operating 30, and/or even remotely by the various associated components, such as a heater or vacuum, as will be discussed further herein.

It should be appreciated that maintenance of a constant flow volume despite changes in pumping system 10, such as an increasing impediment caused by filter dirt accumulation, can require an increasing flow rate or flow pressure of water and result in an increasing motive force from the pump/motor. As such, one aspect of the present invention is to provide a means for operating the motor/pump to provide the increased motive force that provides the increased flow rate and/or pressure to maintain the constant water flow.

It is also be appreciated that operation of the pump motor/pump (e.g., motor speed) has a relationship to the flow rate and/or pressure of the water flow that is utilized to control flow rate and/or flow pressure via control of the pump. Thus, in order to provide an appropriate volumetric flow rate of water for the various operations 104-112, the motor 24 can be operated at various speeds. In one example, to provide an increased flow rate or flow pressure, the motor speed can be increased, and conversely, the motor speed can be decreased to provide a decreased flow rate or flow pressure.

Focusing on the aspect of minimal energy usage, within some know pool filtering applications, it is common to operate a known pump/filter arrangement for some portion (e.g., eight hours) of a clay at effectively a very high speed to accomplish a desired level of pool cleaning. With the present invention, the system (e.g., 10 or 110) with the associated filter arrangement (e.g., 22 or 122) can be operated continuously (e.g., 24 hours a day, or some other amount of time) at an ever-changing minimum level to accomplish the desired level of pool cleaning. It is possible to achieve a very significant savings in energy usage with such a use of the present invention as compared to the known pump operation at the high speed. In one example, the cost savings would be in the range of 90% as compared to a known pump/filter arrangement.

Turning to one aspect that is provided by the present invention, the system can operate to maintain a constant flow of water within the fluid circuit. Maintenance of constant flow is useful in the example that includes a filter arrangement. Moreover, the ability to maintain a constant flow is useful when it is desirable to achieve a specific flow volume during a specific period of time. For example, it may be desirable to filter pool water and achieve a specific number of water turnovers within each day of operation to maintain a desired water clarity.

In an effort to minimize energy consumption, the pumping system 10, 110 can be configured to operate the variable speed motor 24, 124 at a minimum speed while still achieving a desired water flow during a time period (e.g., a desired number of turnovers per day). In one example, a user can provide the pumping system 10, 110 directly with a desired flow rate as determined by the user through calculation, look-up table, etc. However, this may require the user to have an increased understanding of the pool environment and its interaction with the pumping system 10, 110, and further requires modification of the flow rate whenever changes are made to the pool environment.

In another example, the controller 30, 130 can be configured to determine a target flow rate of the water based upon various values. As such, the pumping system 10 can include means for providing a target volume amount of water to be moved by the pumping system 10, 110, and means for providing a time period value for operation thereof. Either or both of the means for providing a target volume amount and a time period can include various input devices, including both local input devices, such as the keypad 40 of the user interface 31, 131, and/or remote input devices, such as input devices linked by a computer network or the like. In addition or alternatively, the controller 30, 130 can even include various methods of calculation, look-up table, graphs, curves, or the like for the target volume amount and/or the time period, such as to retrieve values from memory or the like.

Further, the target volume amount of water can be based upon the volume of the pool (e.g., gallons), or it can even be based upon both the volume of the pool and a number of turnovers desired to be performed within the time period. Thus, for example, where a pool has a volume of 17,000 gallons, the target volume amount could be equal to 17,000 gallons. However, where a user desires multiple turnovers, such as two turnovers, the target volume amount is equal to the volume of the pool multiplied by the number of turnovers (e.g., 17,000 gallons multiplied by 2 turnovers equals 34,000 gallons to be moved). Further, the time period can include various units of time, such as seconds, minutes, hours, days, weeks, months, years, etc. Thus, a user need only input a volume of the swimming poll, and may further input a desired number of turnovers.

Additionally, the pumping system 10, 110 can further include means for determining the target flow rate of water to be moved by the pump based upon the provided target volume amount and time period value. As stated above, the target flow rate (e.g., gallons per minute (gpm)) can be determined by calculation by dividing the target volume amount by the time period value. For example, the equation can be represented as follows: Flow rate=(Pool volume.times.Turnovers per day)/(Cycle 1 time+Cycle 2 time+Cycle 3 time+etc.).

Figure 4B:
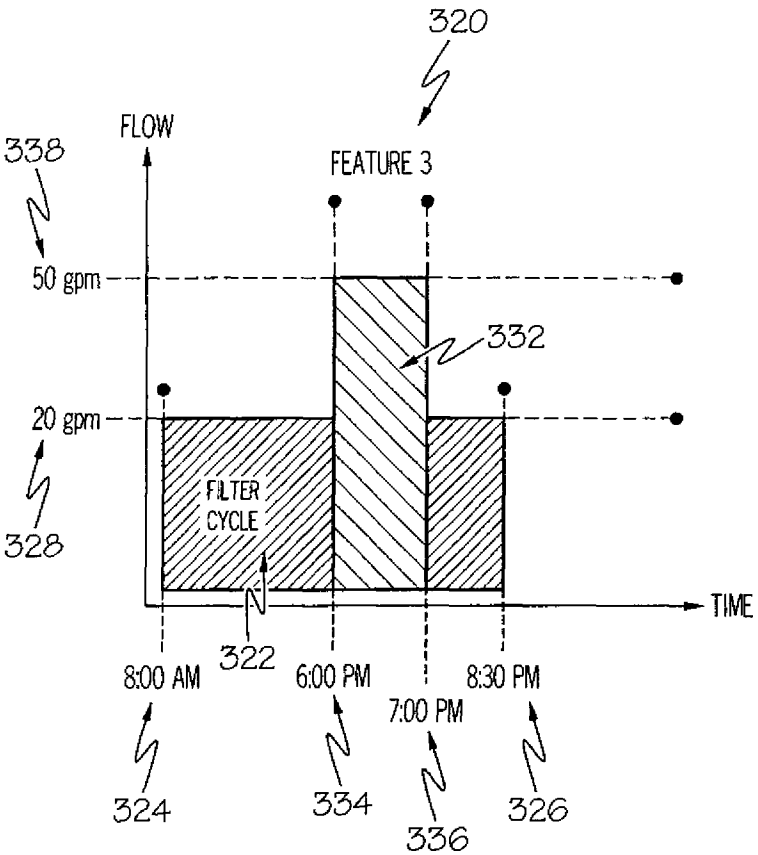
FIG. 4B is similar to FIG. 4A, but illustrates a time line showing a plurality of operations.
Figure 4A:
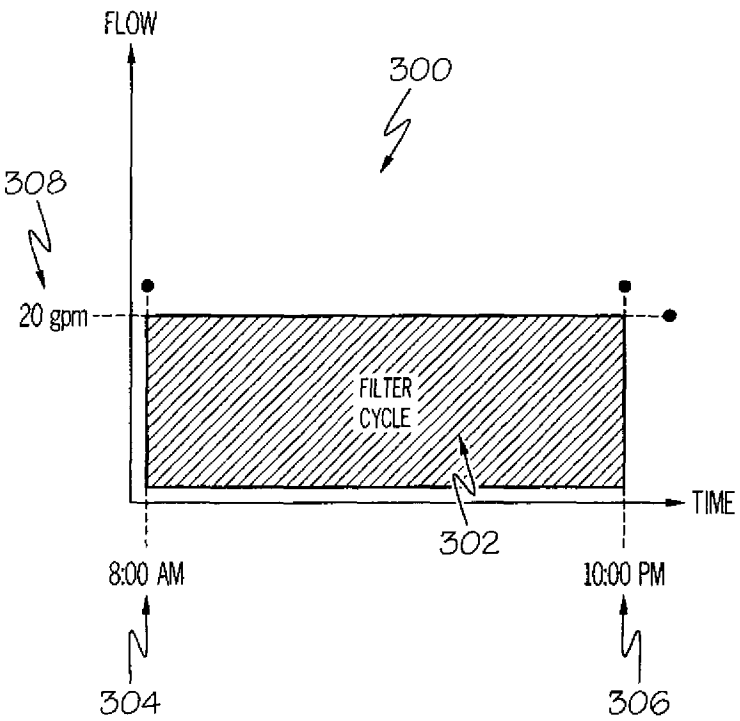
FIG. 4A illustrates a time line showing an operation that may be performed via a system in accordance with an aspect of the present invention.

As shown in chart of FIG. 4A, where the target volume amount of water is 17,000 gallons (e.g., for a pool size of 17,000 gallons at one turnover) and the time period can be 14 hours (e.g., 8:00 AM to 10:00 PM). Calculation of the minimum target flow rate of water results in approximately 20 gallons per minute. Thus, if the pumping system 10, 110 is operated at a rate of 20 gallons per minute for 14 hours, approximately 17,000 gallons will be cycled through the pumping system, and presumably through the filter arrangement 22, 122. It is to be appreciated that the foregoing example constitutes only one example pool size and flow rate, and that the pumping system 10, 110 can be used with various size pools and flow rates.

Further still, after the target flow rate is determined, the pumping system 10, 110 can include means for controlling the motor 24, 124 to adjust the flow rate of water moved by the pump to the determined target flow rate. In one example, the means for controlling can include the controller 30, 130. As mentioned previously, various performance values of the pumping system 10, 110 are interrelated, and can be determined (e.g., calculated, provided via a look-up table, graph or curve, such as a constant flow curve or the like, etc.) based upon particular other performance characteristics of the pumping system 110, such as input power consumed, motor speed, flow rate and/or the flow pressure. In one example, the controller 30, 130 can be configured to determine (e.g., calculation, look-up table, etc.) a minimum motor speed for operating the motor 24, 124 based upon the determined target flow rate. In another example, the controller 30, 130 can be configured to incrementally increase the motor speed, beginning at a baseline value, such as the motor's slowest operating speed, until the pump 24, 124 achieves the target flow rate. As such, the pump 24, 124 can operate at the minimum speed required to maintain the target flow rate in a steady state condition.

It is to be appreciated that the maintenance of a constant flow volume (e.g., the target flow rate) despite changes in pumping system 10, 110, such as an increasing impediment caused by filter dirt accumulation, can require an increasing target flow rate or flow pressure of water, and can result in an increasing power consumption of the pump/motor. However, as discussed herein, the controller 30 can still be configured to maintain the motor speed in a state of minimal energy consumption.

Turning now to another aspect of the present invention, the pumping system 10, 110 can control operation of the pump based upon performance of a plurality of water operations. For example, the pumping system 10, 110 can perform a first water operation with at least one predetermined parameter. The first operation can be routine filtering and the parameter may be timing and or water volume movement (e.g., flow rate, pressure, gallons moved). The pump can also be operated to perform a second water operation, which can be anything else besides just routine filtering (e.g., cleaning, heating, etc.). However, in order to provide for energy conservation, the first operation (e.g., just filtering) can be controlled in response to performance of the second operation (e.g., running a cleaner).

The filtering function, as a free standing operation, is intended to maintain clarity of the pool water. However, it should be appreciated that the pump (e.g., 16 or 116) may also be utilized to operate other functions and devices such as a separate cleaner, a water slide, or the like. As shown in FIGS. 1-2, such an additional operation (e.g., 38 or 138) may be a vacuum device, either manual or autonomous. As can be appreciated, an additional operation involves additional water movement. Also, within the presented examples of FIGS. 1 and 2, the water movement is through the filter arrangement (e.g., 22 or 122). Thus, such additional water movement may be used to supplant the need for other water movement, in accordance with one aspect of the present invention and as described further below.

Further, associated with such other functions and devices is a certain amount of water movement. The present invention, in accordance with one aspect, is based upon an appreciation that such other water movement may be considered as part of the overall desired water movement, cycles, turnover, filtering, etc. As such, water movement associated with such other functions and devices can be utilized as part of the overall water movement to achieve desired values within a specified time frame. Utilizing such water movement can allow for minimization of a purely filtering aspect to permit increased energy efficiency by avoiding unnecessary pump operation.

For example, FIG. 4A illustrates an example time line chart that shows a typical operation 300 that includes a single filter cycle 302. The single filter cycle can include a start time 304 (e.g., 8:00 am), an end time 306 (e.g., 10:00 pm), and a flow rate 308 (e.g., 20 gpm). Thus, if the pumping system 10, 110 is operated at a rate of 20 gallons per minute for 14 hours (e.g., 8:00 am-10:00 pm), approximately 17,000 gallons will be cycled through the filter arrangement 22, 122.

Turning now to FIG. 4B, another example time line chart shows a second typical operation 320 that includes a plurality of operational cycles 322, 332 for a similar 17,000 gallon pool. The operation 320 includes a first cycle 322 having a start time 324 (e.g., 8:00 am), an end time 326 (e.g., 8:30 pm), and a flow rate 328 (e.g., 20 gpm). The operation 320 further includes a second cycle 332 (e.g., Feature 3), such as a vacuum run cycle or a heater run cycle, having a start time 334 (e.g., 6:00 pm), an end time 336 (e.g., 7:00 pm), and a flow rate 338 (e.g., 50 gpm). It is to be appreciated that the various cycle schedules can be predetermined and/or dynamically adjustable.

It should be appreciated that pump operation for all of these cycles, functions, and devices on an unchangeable schedule would be somewhat wasteful. As such, the present invention provides for a reduction of a routine filtration cycle (e.g., cycle 322) in response to occurrence of one or more secondary operations (e.g., cycle 332). As with the previously discussed cycle 302, the pumping system 10, 110 would normally move approximately 17,000 gallons if it is operated at a rate of 20 gallons per minute for 14 hours (e.g., 8:00 am-10:00 pm). However, because the secondary operation (e.g., cycle 332) requires a higher flow rate (e.g., 50 gpm versus 20 gpm), operation of the routine filtration cycle (e.g., cycle 322) can now be reduced. For example, if the routine filtration cycle 322 is operated at 20 gpm for 10 hours (e.g., 8:00 am to 6:00 pm), the pumping system will have moved approximately 12,000 gallons.

Next, if the secondary operation cycle 332 operates at 50 gpm for 1 hour (e.g., 6:00 pm to 7:00 pm), the pumping system 10, 110 will have moved approximately 3,000 gallons. Thus, by the end of the secondary cycle 332 (e.g., 7:00 pm) the pumping system 10, 110 will have cumulatively moved approximately 15,000 gallons. As such, the pumping system needs only move an additional 2,000 gallons. If the pumping system 10, 110 returns to the initial 20 gpm flow rate, then it need only to run for approximately an additional 1.5 hours (e.g., 8:30 pm) instead of the originally scheduled 3 additional hours (e.g., originally scheduled for 10:00 pm end time, see FIG. 4A). Conversely, if the motor 24, 124 had continued to run for until the previously scheduled end time of 10:00 pm, an additional 2,000 gallons of water would have been unnecessarily moved (e.g., a total of 19,000 gallons moved), thereby wasting energy.

Accordingly, the pumping system 10, 110 can alter operation motor 24, 124 based upon the operation of multiple cycles 322, 332 to conserve energy and increase efficiency of the pumping system 10, 110 (e.g., a power save mode). It is to be appreciated that the pumping system 10, 110 can alter operation of the motor by further slowing the motor speed, such as in situations where at least some water flow is required to be maintained within the pool, or can even stop operation of the motor 24, 124 to eliminate further power consumption.

Reducing power consumption of the pumping system 10, 110 as described above can be accomplished in various manners. In one example, the pumping system 10, 110 can include means for providing a target volume amount of water to be moved by the pump 24, 124, and means for providing an operational time period for the pump 24, 124 (e.g., a time period during which the pump 24, 124 is in an operational state). As stated previously, either or both of the means for providing the target volume amount and the operational time period can include various local or remote input devices, and/or even calculation, charts, look-up tables, etc.

The pumping system 10, 110 can further include means for determining a volume of water moved by the pump 24, 124 during the operational time period. The means for determining a volume of water moved can include a sensor 50, 150, such as a flow meter or the like for measuring the volume of water moved by the pump 24, 124. The controller 30, 130 can then use that information to determine a cumulative volume of water flow through the pool. In addition or alternatively, the controller 30, 130 can indirectly determine a volume of water moved through a "sensorless" analysis of one or more performance values 146 of the pumping system 10, 110 during operation thereof. For example, as previously discussed, it is an understanding that operation of the pump motor/pump (e.g., power consumption, motor speed, etc.) has a relationship to the flow rate and/or pressure of the water flow (e.g., flow, pressure) that can be utilized to determine particular operational values (e.g., through calculation, charts, look-up table, etc.).

The pumping system 10, 110 can further include means for altering the operational time period based upon the volume of water moved during the operational time period. As discussed above, the controller 30, 130 can be configured to determine the cumulative volume of water flow through the pool. It is to be appreciated that the determination of cumulative water flow can be performed at various time intervals, randomly, or can even be performed in real time. As such, the controller 30, 130 can be configured to monitor the cumulative volume of water being moved by the pumping system 10, 110 during the operational time period (e.g., keep a running total or the like).

Thus, as illustrated above with the discussion associated with FIG. 4B, the means for altering the operational time period can be configured to reduce the operational time period based upon a water operation 320 that includes a plurality of operational cycles 322, 332 having various water flow rates. In one example, the operational time period can include a gross operational time period, such as 14 hours, and the means for altering can thereby reduce the time period (e.g., reduce the gross time period from 14 hours to 12.5 hours) as required in accordance with the relationship between the cumulative water flow and the target volume of water to be moved.

In another example, the operational time period can be bounded by an end time, and/or can even be bounded by a start time and an end time. Thus, the controller 30, 130 can further comprise means for determining an end time (e.g., such as end time 326) based upon the operational time period. For example, as shown in FIGS. 4A and 4B, the operational time period began at 8:00 am (e.g., start time 304), and it was determined to operate the pump 24, 124 for 14 hours at 20 gpm. Thus, the end time 306 can be determined to be 10:00 pm (e.g., 8:00 am plus 14 hours). However, as shown in FIG. 4B, the introduction of an additional operation cycle 332 that operated at a higher water flow rate can permit the reduction of the operational time period. Thus, the controller 30, 130 can recalculate a new end time according to the remaining volume of water to be moved. As shown, the new end time 326 can be calculated to be 8:30 pm.

Accordingly, in an effort to conserve energy consumption of the motor 24, 124, the pumping system 10, 110 can further include means for altering operation of the motor 24, 124 based upon the operational time period. For example, the controller 30, 130 can be configured to reduce (e.g., operate at a slower speed), or even stop, operation of the motor 24, 124 based upon the operational time period. Thus, when the operational time period in real time exceeds the end time 326, the controller 30, 130 can reduce or stop operation of the motor 24, 124 to conserve energy consumption thereof. Thus, as illustrated in FIG. 4B, the controller 30, 130 can alter operation of the motor 24, 124 after the real time of 8:30 pm. It is to be appreciated that the phrase "real time" refers to the real-world time associated with a clock or other timing device operatively connected to the controller 30, 130.

It is further to be appreciated that the various examples discussed herein have included only two cycles, and that the addition of a second cycle is associated with a greater water flow that thereby necessitates the overall operational time period of the motor 24, 124 to be reduced. However, the present invention can include various numbers of operational cycles, each cycle having various operational time periods and/or various water flow rates. In addition or alternatively, the present invention can operate in a dynamic manner to accommodate the addition or removal of various operational cycles at various times, even during a current operational cycle.

In addition or alternatively, the present invention can further be adapted to increase an operational time period of the pump 24, 124 in the event that one or more additional operational cycles include a lower flow rate. Such an increase in the operational time period can be accomplished in a similar fashion to that discussed above, though from a point of view of a total volume flow deficiency. For example, where a primary filtering cycle includes a steady state flow rate of 20 gpm, and a secondary cycle includes a flow rate of only 10 gpm, the controller 30, 130 can be configured to alter the operational time period to be longer to thereby make up for a deficiency in overall water volume moved. In addition or alternatively, the controller 30, 130 could also be configured to increase the flow rate of the primary cycle to make up for the water volume deficiency without altering the operational time period (e.g., increase the flow rate to 30 gpm without changing the end time). As discussed herein, the controller 30, 130 can choose among the various options based upon various considerations, such as minimizing power consumption or time-of-day operation.

Reducing power consumption of the pumping system 10, 110 as described above can also be accomplished in various other manners. Thus, in another example, the pumping system 10, 110 can further include means for determining a volume of water moved by the pump 24, 124, such as through a sensor 50, 150 (e.g., flow meter or the like), or even through a "sensorless" method implemented with the controller 30, 130 as discussed previously herein. The volume of water moved can include water moved from one or more operational cycles (e.g., see FIG. 4B). For example, a first operational cycle 322 can be associated with a first flow rate 328, and a second operational cycle 332 can be associated with a second flow rate 338, and the controller 30, 130 can determine a total volume of water moved during both the first and second operational cycles 322, 332. In one example, the controller 30, 130 can determine the volume of water moved in each operational cycle individually and add the amounts to determine the total volume moved. In another example, the controller 30, 130 can keep a running total of the total volume moved (e.g., a gross total), regardless of operational cycles. Thus, as discussed above, the controller 30, 130 can use that information to determine a cumulative volume of water flow through the pool. It is to be appreciated that the determination of cumulative water flow can be performed at various time intervals, randomly, or can even be performed in real time.

Additionally, the pumping system 10, 110 can further include means for altering operation of the motor 24, 124 when the volume of water moved by the pump 12, 112 exceeds a target volume amount. As discussed above, the target volume amount of water can be provided in various manners, including input by a user (e.g., through a local or remote user interface 31, 131) and/or determination by the controller 30, 130.

Thus, for example, where the target volume amount is 17,000 gallons, the controller 30, 130 can monitor the total volume of water moved by the pumping system 10, 110, and can alter operation of the motor 24, 124 when the total volume of water moved exceeds 17,000 gallons, regardless of a time schedule. It is to be appreciated that the pumping system 10, 110 can alter operation of the motor by slowing the motor speed, such as in situations where at least some water flow is required to be maintained within the pool, or can even stop operation of the motor 24, 124 to eliminate further power consumption.

In addition to monitoring the volume flow of water moved by the pump 24, 124, the controller 30, 130 can also monitor the volume flow of water moved within a time period, such as the operational time period discussed above. Thus, for example, where the operation time period is determined to be fourteen hours, the controller 30, 130 can monitor the volume flow rate of water moved only during the fourteen hours. As such, the controller 30, 130 can then alter operation of the motor 24, 124 depending upon whether the cumulative volume of water moved (e.g., including water flow from various operational cycles) exceeds the target volume amount during that fourteen hour time period. It is to be appreciated that, similar to the above description, the controller 30, 130 can also be adapted to increase the flow rate of water moved by the pump 24, 124 to make up for a water volume deficiency (e.g., the total volume of water does not exceed the target volume of water by the end of the time period). However, it is to be appreciated that a time period is not required, and the total volume of water moved can be determined independently of a time period.

Turning now to yet another aspect of the present invention, the pumping system 10, 110 can further be configured to determine an optimized flow rate value based upon various variables. The determination of an optimized flow rate can be performed within the pumping system 10, 110, such as within the controller 30, 130. However, it is to be appreciated that the determination of an optimized flow rate can even be performed remotely, such as on a computer or the like that may or may not be operatively connected to the pumping system 10, 110. For example, the determination of an optimized flow rate value can be performed on a personal computer or the like, and can even take the form of a computer program or algorithm to aid a user reducing power consumption of the pump 24, 124 for a specific application (e.g., a specific swimming pool).

Figure 5:
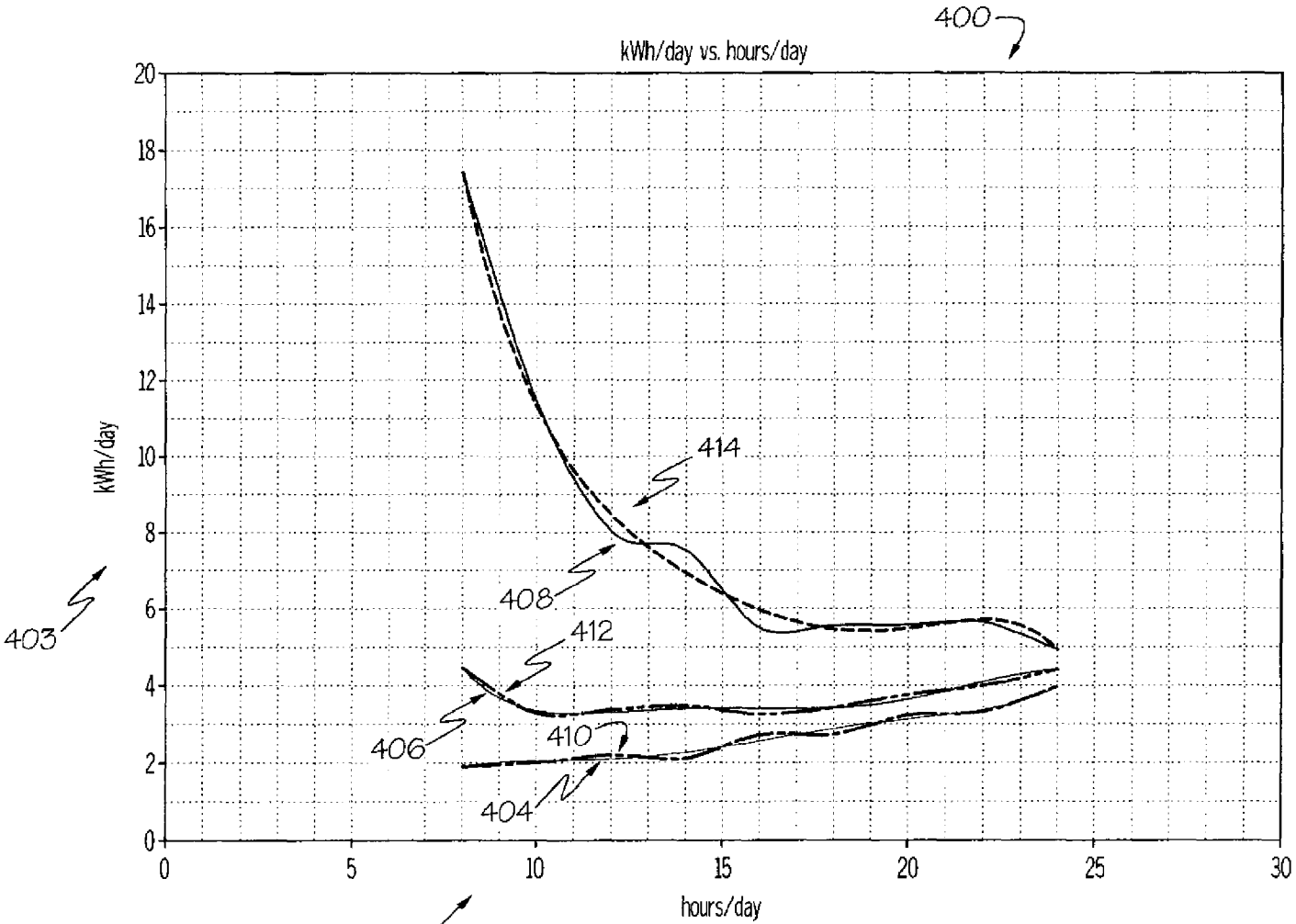
FIG. 5 illustrates a plurality of power optimization curves in accordance with another aspect of the present invention

For the sake of brevity, the following example will include a discussion of the controller 30, 130, and the various elements can be implemented in a computer program, algorithm, or the like. In determining an optimized flow rate, the pumping system 10, 110 can include means for providing a range of time period values, such as a range of seconds, minutes, hours, days, weeks, months, years, etc. For example, as shown on chart 400 of FIG. 5, the means for providing can provide a range of time period values 402 for operation of the motor 24, 124 that includes 0 hours per day to 24 hours per day. Thus, the range of time period values can refer to various operational time periods for operation of the motor 24, 124 in terms of a certain number of hours within a single day. However, the range of time period values can also include various other time frames, such as minutes per day, hours per week, etc.

Further, the pumping system 10, 110 can include means for determining a range of flow rate values of water to be moved by the pump 24, 124 based upon a target volume of water and the range of time period values. As discussed above, the target volume of water to be moved by the pump 24, 124 can be provided by a user interface 31, 131, and/or determined by calculation, look-up table, chart, etc. In one example, a user can provide the target volume of water through the keypad 40. Thus, a particular flow rate value (e.g., gallons per minute) can be determined for each time value within the range of time values by dividing the target volume of water by each time value. For example, where the target volume of water is equal to 17,000 gallons, and where the range of time values includes 10 hours, 15 hours, and 20 hours, the associated range of flow rates can be calculate to be approximately 28 gpm, 19 gpm, and 14 gpm.

Further still, the pumping system 10, 110 can include means for determining a range of motor speed values (e.g., RPM) based upon the range of determined flow rate values. Each motor speed value can be associated with a flow rate value. In one example, the controller 30, 130 can determine each motor speed value through calculation, look-up table, chart, etc. As discussed previously, a relationship can be established between the various operating characteristics of the pumping system 10, 110, such as motor speed, power consumption, flow rate, flow pressure, etc. Thus, for example, a particular motor speed can be determined from operation of the motor 24, 124 at a particular flow rate and at a particular flow pressure. As such, a range of motor speed values can be determined and associated with each of the flow rate values.

The pumping system 10, 110 can further include means for determining a range of power consumption values (e.g., instantaneous power in Watts or even power over time in kWh) of the motor 24, 124 based upon the determined motor speed values. Each power consumption value can be associated with a motor speed value. As before, a relationship can be established between the various operating characteristics of the pumping system 10, 110, such as motor speed, power consumption, flow rate, flow pressure, etc. Thus, for example, a particular power consumption value can be determined from operation of the motor 24, 124 at a particular motor speed and flow rate. As such, a range of power consumption values can be determined and associated with each of the motor speed values.

The pumping system 10, 110 can further include means for determining an optimized flow rate value that is associated with the lowest power consumption value of the motor 24, 124. For example, the optimized flow rate value can be the flow rate value of the range of flow rate values that is associated, through the intermediate values discussed above, with the lowest power consumption value of the range of power consumption values. In another example, as shown in the chart 400 of FIG. 5, the lowest power consumption value can be calculated from operational data of the pumping system 10, 110. The chart 400 illustrates a relationship between a range of time period values 402 on the x-axis, and a range of power consumption values 403 on the y-axis, though the chart 400 can be arranged in various other manners and can include various other information.

The chart 400 includes operational data for three pool sizes, such as 17,000 gallon pool 404, a 30,000 gallon pool 406, and a 50,000 gallon pool 408, though various size pools can be similarly shown, and only the pool size associated with a user's particular swimming pool is required. As illustrated, each set of operational data 404, 406, 408 includes minimum and maximum values (e.g., minimum and maximum power consumption values). Thus, by determining a minimum value of the power consumption for a particular pool size, an optimal time period (e.g., hours per day for operation of the pump) can be determined, and subsequently an optimal flow rate can be determined. However, as shown, the minimum power consumption value for the various pool sizes 404, 406, 408 can occur at different values. For example, regarding the 17,000 gallon pool 404, the minimum power consumption value can occur with a relatively lesser operational time (e.g., operating the pump for less hours per day). However, it is to be appreciated that as the pool volume is increased, operation of the pump 24, 124 for a lesser amount of time can generally require a higher flow rate, which can generally require a higher motor speed and higher power consumption. Conversely, operating the motor 24, 124 at a slower speed for a longer period of time can result in a relatively lower power consumption. Thus, regarding the 50,000 gallon pool 408, the minimum power consumption value can occur with a relatively greater operational time, such as around 16 or 17 hours per day.

The minimum value of the power consumption can be determined in various manners. In one example, the operational data can be arranged in tables or the like, and the minimum data point located therein. In another example, the chart 400 can include a mathematical equation 410, 412, 414 adapted to approximately fit to the operational data of each pool 404, 406, 408, respectively. The approximate mathematical equation can have various forms, such as a linear, polynomial, and/or exponential equation, and can be determined by various known methods, such as a regression technique or the like. The controller 30, 130 can determine the minimum power consumption value by finding the lowest value of the mathematical equation, which can be performed by various known techniques. Because the fit line can be represented by a continuous equation, the values can include whole numbers (e.g., 20 gpm for 14 hours) or can even include decimals (e.g., 24.5 gpm for 12.7 hours). However, it is to be appreciated that because the mathematical equation is an approximation of the operational data 404, 406, 408, various other factors, such as correction factors or the like, may be applied to facilitate determination of the minimum value.

Further still, it is to be appreciated that variations in cycle times and/or determinations of flow rates can be based upon the varying cost of electricity over time. For example, in some geographical regions, energy cost is relatively higher during the daytime hours, and relatively lower during the nighttime hours. Thus, a determined flow rate and operational schedule may include a lower flow rate operable for a longer period of time during the nighttime hours to further reduce a user's energy costs.

Thus, once the controller 30, 130 determines an optimal flow rate (or a user inputs an optimal flow rate based upon a remote determination made using a computer program running on a personal computer or the like), the pumping system 10, 110 can further include means for controlling the motor 24, 124 to adjust the flow rate of water moved by the pump 12, 112 to the optimized flow rate value. The controller 30, 130 can operate to maintain that optimized flow rate value as discussed previously herein, and/or can even adjust the flow rate among various operational flow rates. Additionally, the controller 30, 130 can further monitor an operational time period and/or a total volume of water moved by the system, as discussed herein, and can alter operation of the motor accordingly.

Figure 7:
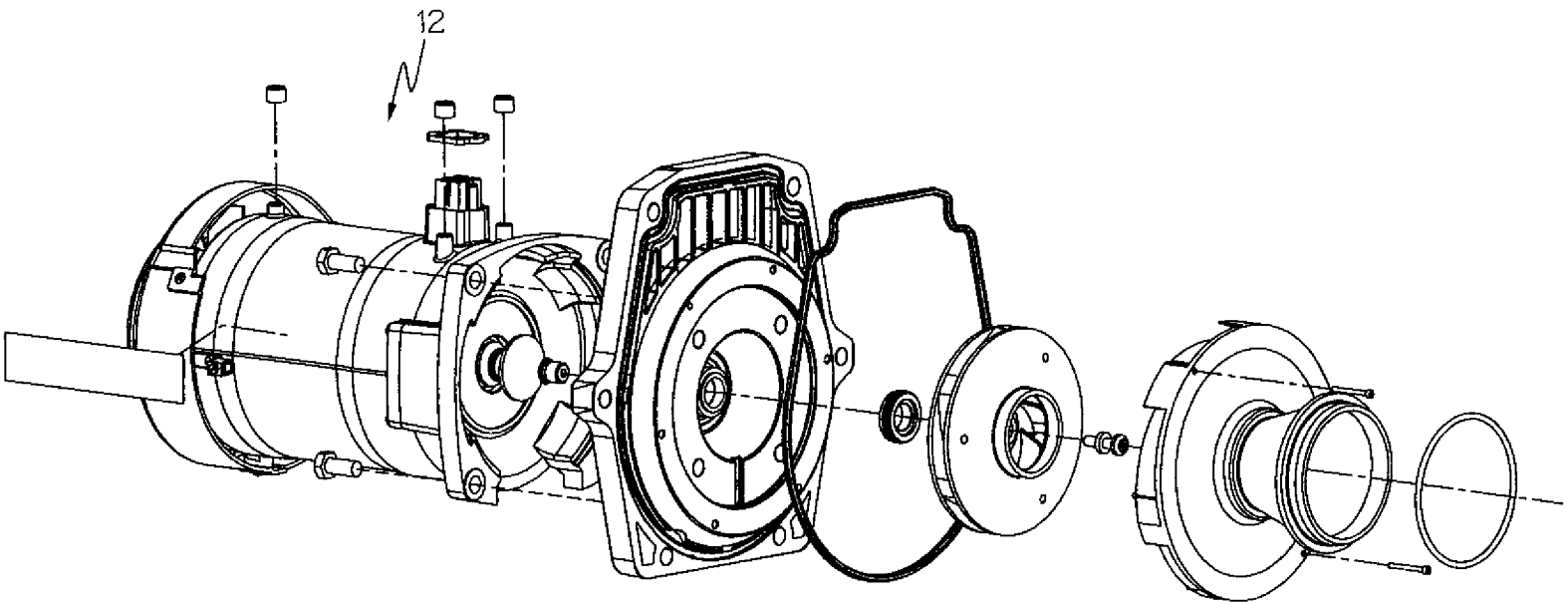
FIG. 7 is a perspective, partially exploded view of a pump of the unit shown in FIG. 6.
Figure 8:
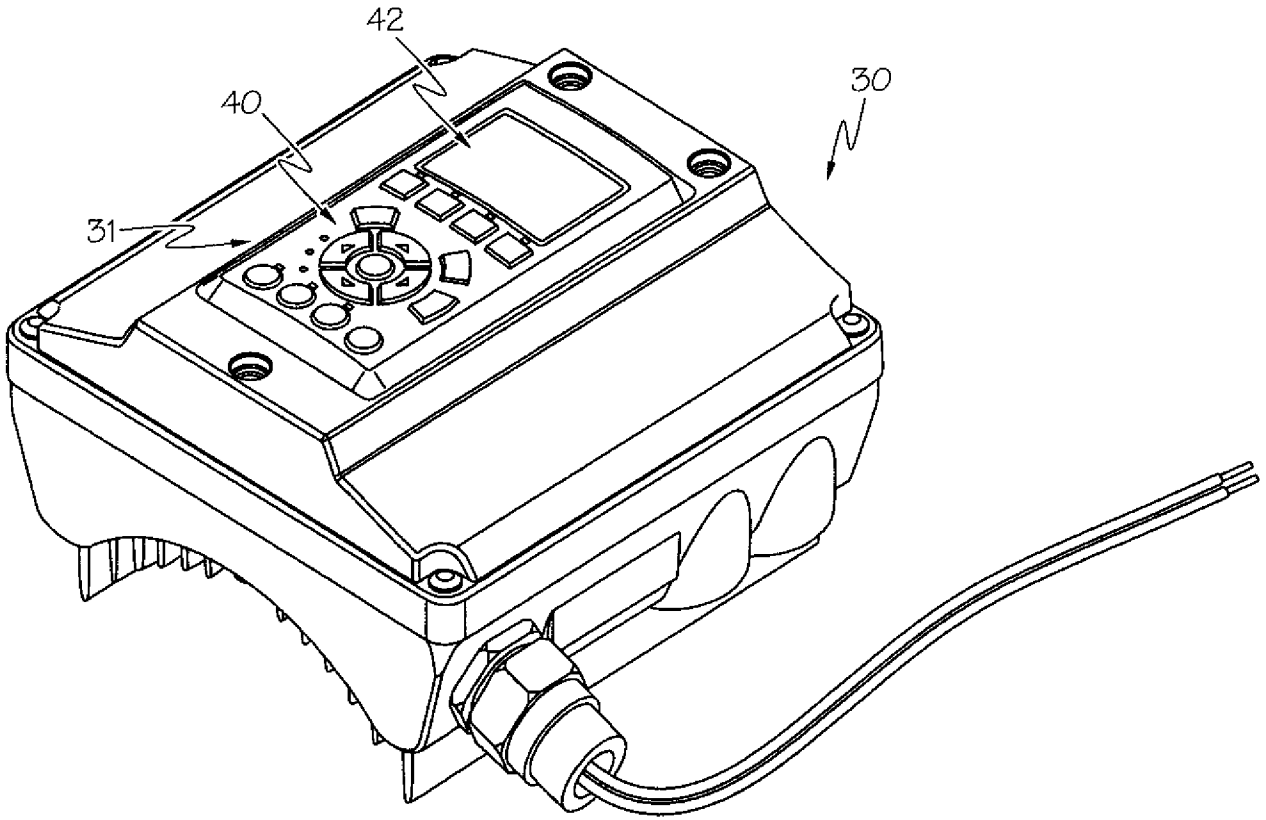
FIG. 8 is a perspective view of a controller unit of the pump unit shown in FIG. 6.

It is to be appreciated that the physical appearance of the components of the system (e.g., 10 or 110) may vary. As some examples of the components, attention is directed to FIGS. 6-8. FIG. 6 is a perspective view of the pump unit 12 and the controller 30 for the system 10 shown in FIG. 1. FIG. 7 is an exploded perspective view of some of the components of the pump unit 12. FIG. 8 is a perspective view of the controller 30.

It should be evident that this disclosure is by way of example and that various changes may be made by adding, modifying or eliminating details without departing from the scope of the teaching contained in this disclosure. As such it is to be appreciated that the person of ordinary skill in the art will perceive changes, modifications, and improvements to the example disclosed herein. Such changes, modifications, and improvements are intended to be within the scope of the present invention.

We claim:

1. A pumping system for at least one aquatic application, the at least one aquatic application including a pool, the pumping system comprising:

a pump;

a motor coupled to the pump; and a controller in communication with the motor, the controller altering a routine filtering cycle operation in response to performance of a pool cleaning operation, the controller monitoring a cumulative volume of water movement during the routine filtering cycle operation and the pool cleaning operation, the controller altering at least one of a flow rate, a motor speed, and a time period of at least one of the routine filtering cycle operation and the pool cleaning operation based on the cumulative volume of water movement.

2. The pumping system of claim 1, wherein the pool cleaning operation requires a higher flow rate, and wherein the controller alters the routine filtering cycle operation in response to the pool cleaning operation.

3. The pumping system of claim 1, wherein the controller further alters the routine filtering cycle operation in response to the performance of a heater operation.

4. The pumping system of claim 2, wherein the controller stops operation of the motor after completion of the pool cleaning operation to eliminate further power consumption.

5. The pumping system of claim 1, wherein a target volume of water to be moved and an operational time period for the pumping system are received from a user interface.

6. The pumping system of claim 5, wherein the operational time period is altered by the controller based on the cumulative volume of water movement.

7. The pumping system of claim 5, wherein the controller alters operation of the motor when the cumulative volume of water movement exceeds the target volume.

8. The pumping system of claim 6, wherein a gross operational time period is reduced.

9. The pumping system of claim 6, wherein the controller recalculates a new end time of the operational time period according to a remaining volume to be moved.

10. The pumping system of claim 1, wherein the pool cleaning operation requires a lower flow rate, and wherein the controller increases at least one of a flow rate and an operational time period of the routine filtering cycle operation.

11. The pumping system of claim 1, wherein an optimized flow rate for each one of the routine filtering cycle operation and the pool cleaning operation is at least one of determined by the controller and provided by a user.

12. The pumping system of claim 11, wherein the optimized flow rate is determined by dividing a target volume by a time value.

13. The pumping system of claim 11, wherein the controller determines a motor speed value for each optimized flow rate.

14. The pumping system of claim 13, wherein the controller determines a power consumption value for each motor speed and optimized flow rate.

15. The pumping system of claim 14, wherein the controller chooses a lowest possible power consumption value from a range of power consumption values for the optimized flow rate.

* * * * *